US012066222B2

(12) United States Patent
Kumakura et al.

(10) Patent No.: US 12,066,222 B2
(45) Date of Patent: Aug. 20, 2024

(54) REFRIGERATION CYCLE DEVICE

(71) Applicant: DAIKIN INDUSTRIES, LTD., Osaka (JP)

(72) Inventors: Eiji Kumakura, Osaka (JP); Ikuhiro Iwata, Osaka (JP); Kazuhiro Furusho, Osaka (JP); Ryusuke Fujiyoshi, Osaka (JP); Hiromune Matsuoka, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 475 days.

(21) Appl. No.: 17/282,143

(22) PCT Filed: Sep. 30, 2019

(86) PCT No.: PCT/JP2019/038451
§ 371 (c)(1),
(2) Date: Apr. 1, 2021

(87) PCT Pub. No.: WO2020/071299
PCT Pub. Date: Apr. 9, 2020

(65) Prior Publication Data

US 2021/0356177 A1 Nov. 18, 2021

(30) Foreign Application Priority Data

Oct. 2, 2018 (JP) ..... 2018-187365
Oct. 2, 2018 (JP) ..... 2018-187367

(51) Int. Cl.
*F25B 13/00* (2006.01)
*F25B 40/02* (2006.01)

(52) U.S. Cl.
CPC ..... *F25B 13/00* (2013.01); *F25B 40/02* (2013.01); *F25B 2313/006* (2013.01);
(Continued)

(58) Field of Classification Search
CPC .... F25B 13/00; F25B 40/02; F25B 2313/006; F25B 2313/009; F25B 2313/0233;
(Continued)

(56) References Cited

U.S. PATENT DOCUMENTS 7,526,924 B2 5/2009 Wakamoto et al.
2007/0271936 A1 11/2007 Wakamoto et al.
(Continued)

FOREIGN PATENT DOCUMENTS

CN 203964427 U * 11/2014
EP 3 425 306 A1 1/2019
(Continued)

OTHER PUBLICATIONS

Sasaki et al., Supercooling System, Feb. 19, 2009. JP2009036508A, Whole Document (Year: 2009).*
(Continued)

*Primary Examiner* — Larry L Furdge
(74) *Attorney, Agent, or Firm* — Birch, Stewart, Kolasch & Birch, LLP

(57) ABSTRACT

At a refrigeration cycle device, an injection pipe and an economizer heat exchanger are provided at a main refrigerant circuit. In addition, the refrigeration cycle device includes a sub-refrigerant circuit having a sub-usage-side heat exchanger. At the refrigeration cycle device, the sub-usage-side heat exchanger functions as an evaporator of a sub-refrigerant and cools a main refrigerant that has been cooled at the economizer heat exchanger, or functions as a radiator of the sub-refrigerant and heats the main refrigerant that has been cooled at the economizer heat exchanger.

12 Claims, 9 Drawing Sheets

(52) U.S. Cl.
CPC . *F25B 2313/009* (2013.01); *F25B 2313/0233* (2013.01); *F25B 2313/0252* (2013.01); *F25B 2400/13* (2013.01); *F25B 2600/2509* (2013.01)

(58) Field of Classification Search
CPC ..... F25B 2313/0252; F25B 2400/13; F25B 2600/2509
See application file for complete search history.

(56) References Cited

U.S. PATENT DOCUMENTS

| | | | | |
|---|---|---|---|---|
| 2009/0158761 | A1* | 6/2009 | Wakamoto | F25B 13/00 62/175 |
| 2010/0251741 | A1* | 10/2010 | Yoshimi | F25B 1/10 62/324.5 |
| 2011/0072836 | A1* | 3/2011 | Wang | F25B 49/022 62/507 |
| 2012/0234026 | A1 | 9/2012 | Oh et al. | |
| 2016/0265814 | A1* | 9/2016 | Pfister | F25B 39/04 |
| 2016/0320105 | A1 | 11/2016 | Okazaki | |
| 2018/0195794 | A1* | 7/2018 | Saunders | F25B 7/00 |
| 2021/0215398 | A1 | 7/2021 | Iwata et al. | |
| 2021/0356177 | A1 | 11/2021 | Kumakura et al. | |
| 2022/0003461 | A1 | 1/2022 | Iwata et al. | |

FOREIGN PATENT DOCUMENTS

| | | | | |
|---|---|---|---|---|
| JP | 2006-194565 | A | | 7/2006 |
| JP | 2007-3169 | A | | 1/2007 |
| JP | 2007-225265 | A | | 9/2007 |
| JP | 2008-249219 | A | | 10/2008 |
| JP | 2009036508 | A | * | 2/2009 |
| JP | 4753719 | B2 | | 8/2011 |
| JP | 4804396 | B2 | | 11/2011 |
| JP | 2012067962 | A | * | 4/2012 |
| JP | 2012-189258 | A | | 10/2012 |
| JP | 2013-130358 | A | | 7/2013 |
| JP | 2013-139938 | A | | 7/2013 |
| JP | 2013-160427 | A | | 8/2013 |
| JP | 2013-210133 | A | | 10/2013 |
| JP | 2013-210155 | A | | 10/2013 |
| JP | 2013-210158 | A | | 10/2013 |
| WO | WO 2005/052467 | A1 | | 6/2005 |
| WO | WO 2012/002248 | A1 | | 1/2012 |
| WO | WO 2017/150349 | A1 | | 9/2017 |

OTHER PUBLICATIONS

Wang et al., Intelligent Protection System of Overlapped High Temperature Heat Pump, Nov. 26, 2014, CN203964427U, Whole Document (Year: 2014).*

Takayama, Binary Refrigerating Cycle Device, Apr. 5, 2012, JP2012067962A, Whole Document (Year: 2012).*

Extended European Search Report for European Application No. 19869333.5, dated Oct. 15, 2021.

Extended European Search Report for European Application No. 19869334.3, dated Oct. 21, 2021.

International Search Report, issued in PCT/JP2019/038451, dated Nov. 26, 2019.

English translation of International Preliminary Report on Patentability and Written Opinion of the International Searching Authority for International Application No. PCT/JP2019/038451, dated Apr. 15, 2021.

* cited by examiner

REFRIGERATION CYCLE DEVICE

TECHNICAL FIELD

The present disclosure relates to a refrigeration cycle device in which an injection pipe and an economizer heat exchanger are provided at a refrigerant circuit having a compressor, a heat-source-side heat exchanger, a usage-side heat exchanger, and a flow-path switching mechanism, the injection pipe causing a refrigerant that flows between the heat-source-side heat exchanger and the usage-side heat exchanger to branch off and to be sent to the compressor, the economizer heat exchanger cooling a refrigerant that flows between the heat-source-side heat exchanger and the usage-side heat exchanger by heat exchange with a refrigerant that flows in the injection pipe.

BACKGROUND ART

Hitherto, there has existed a refrigeration cycle device that includes a refrigerant circuit having a compressor, a heat-source-side heat exchanger, a usage-side heat exchanger, and a flow-path switching mechanism. As such a refrigeration cycle device, as described in Patent Literature 1 (Japanese Unexamined Patent Application Publication No. 2013-139938), there exists a device in which an injection pipe and an economizer heat exchanger are provided at a refrigerant circuit, the injection pipe causing a refrigerant that flows between the heat-source-side heat exchanger and the usage-side heat exchanger to branch off and to be sent to the compressor, the economizer heat exchanger cooling a refrigerant that flows between the heat-source-side heat exchanger and the usage-side heat exchanger by heat exchange with a refrigerant that flows in the injection pipe.

SUMMARY OF INVENTION

Technical Problem

In the refrigeration cycle device that is known in the art above, the injection pipe and the economizer heat exchanger are provided at the refrigerant circuit. Therefore, when performing an operation (cooling operation) by switching the flow-path switching mechanism to a cooling operation state in which a refrigerant circulates so that the usage-side heat exchanger functions as an evaporator of the refrigerant, the refrigerant that flows between the heat-source-side heat exchanger and the usage-side heat exchanger can be cooled in the economizer heat exchanger. Consequently, the enthalpy of a refrigerant that is sent to the usage-side heat exchanger is reduced, and the heat exchange capacity that is obtained by evaporation of the refrigerant at the usage-side heat exchanger (evaporation capacity of the usage-side heat exchanger) can be increased. In addition, when performing an operation (heating operation) by switching the flow-path switching mechanism to a heating operation state in which a refrigerant circulates so that the usage-side heat exchanger functions as a radiator of the refrigerant, a part of the refrigerant that flows between the heat-source-side heat exchanger and the usage-side heat exchanger is sent to the compressor via the injection pipe, and the flow rate of the refrigerant that is discharged from the compressor can be increased accordingly. Consequently, the flow rate of the refrigerant that is sent to the usage-side heat exchanger is increased, and the heat exchange capacity that is obtained by heat dissipation of the refrigerant at the usage-side heat exchanger (radiation capacity of the usage-side heat exchanger) can be increased.

However, in the cooling operation, depending upon operating conditions, the radiation capacity of the refrigerant at the heat-source-side heat exchanger is sometimes reduced, and, thus, the cooling capacity of the refrigerant at the economizer heat exchanger becomes insufficient, as a result of which it tends to be difficult to increase the evaporation capacity of the usage-side heat exchanger. In addition, in the heating operation, since the refrigerant that flows between the heat-source-side heat exchanger and the usage-side heat exchanger is cooled at the economizer heat exchanger in accordance with the flow rate of the refrigerant that is sent to the compressor via the injection pipe, the enthalpy of the refrigerant that is sent to the heat-source-side heat exchanger is reduced. Therefore, the heat-exchange amount required to evaporate the refrigerant at the heat-source-side heat exchanger tends to increase.

Consequently, it is desirable that the refrigeration cycle device in which the injection pipe and the economizer heat exchanger are provided at the refrigerant circuit be capable of increasing the evaporation capacity of the usage-side heat exchanger when operating to cause the usage-side heat exchanger to function as an evaporator of a refrigerant, and be capable of reducing the heat-exchange amount required to evaporate a refrigerant at the heat-source-side heat exchanger when operating to cause the usage-side heat exchanger to function as a radiator of a refrigerant.

Solution to Problem

A refrigeration cycle device according to a first aspect includes a main refrigerant circuit and a sub-refrigerant circuit. The main refrigerant circuit has a main compressor, a main heat-source-side heat exchanger, a main usage-side heat exchanger, an injection pipe, an economizer heat exchanger, and a main flow-path switching mechanism. The main compressor is a compressor that compresses a main refrigerant. The main heat-source-side heat exchanger is a heat exchanger that functions as a radiator (a heat dissipater) or an evaporator of the main refrigerant. The main usage-side heat exchanger is a heat exchanger that functions as an evaporator or a radiator of the main refrigerant. The injection pipe is a refrigerant pipe that causes the main refrigerant that flows between the main heat-source-side heat exchanger and the main usage-side heat exchanger to branch off and to be sent to the main compressor. The economizer heat exchanger is a heat exchanger that cools the main refrigerant that flows between the main heat-source-side heat exchanger and the main usage-side heat exchanger by heat exchange with the main refrigerant that flows in the injection pipe. The main flow-path switching mechanism switches between a main cooling operation state, in which the main refrigerant is caused to circulate so that the main usage-side heat exchanger functions as the evaporator of the main refrigerant, and a main heating operation state, in which the main refrigerant is caused to circulate so that the main usage-side heat exchanger functions as the radiator of the main refrigerant. The main refrigerant circuit has a sub-usage-side heat exchanger that functions as a cooler or a heater of the main refrigerant that has been cooled at the economizer heat exchanger. The sub-refrigerant circuit has a sub-compressor, a sub-heat-source-side heat exchanger, the sub-usage-side heat exchanger, and a sub-flow-path switching mechanism. The sub-compressor is a compressor that compresses a sub-refrigerant. The sub-heat-source-side heat exchanger functions as a radiator or an evaporator of the sub-refrigerant. The sub-usage-side heat exchanger functions as an evaporator of the sub-refrigerant and cools the main refrigerant that has been cooled at the economizer heat exchanger, or functions as a radiator of the sub-refrigerant and heats the main refrigerant that has been cooled at the economizer heat exchanger. The sub-flow-path switching mechanism switches between a sub-cooling operation state, in which the sub-refrigerant is caused to circulate so that the sub-usage-side heat exchanger functions as the evaporator of the sub-refrigerant, and a sub-heating operation state, in which the sub-refrigerant is caused to circulate so that the sub-usage-side heat exchanger functions as the radiator of the sub-refrigerant.

Here, as described above, not only are the injection pipe and the economizer heat exchanger that are the same as those known in the art provided at the main refrigerant circuit in which the main refrigerant circulates, but also the sub-refrigerant circuit that differs from the main refrigerant circuit and in which the sub-refrigerant circulates is provided. In addition, the sub-usage-side heat exchanger that is provided at the sub-refrigerant circuit is provided at the main refrigerant circuit so that, when performing an operation (cooling operation) by switching the main flow-path switching mechanism to the cooling operation state in which the main refrigerant circulates so that the main usage-side heat exchanger functions as the evaporator of the main refrigerant, the sub-usage-side heat exchanger functions as the evaporator of the sub-refrigerant that cools the main refrigerant that has been cooled at the economizer heat exchanger. Therefore, here, the enthalpy of the main refrigerant that is sent to the main usage-side heat exchanger is further reduced, and the heat exchange capacity that is obtained by evaporation of the main refrigerant at the main usage-side heat exchanger (evaporation capacity of the usage-side heat exchanger) can be increased. In addition, the sub-usage-side heat exchanger that is provided at the sub-refrigerant circuit is provided at the main refrigerant circuit so that, when performing an operation (heating operation) by switching the main flow-path switching mechanism to the heating operation state in which the main refrigerant circulates so that the main usage-side heat exchanger functions as the radiator of the refrigerant, the sub-usage-side heat exchanger functions as the radiator of the sub-refrigerant and functions as the radiator of the sub-refrigerant that heats the main refrigerant that has been cooled at the economizer heat exchanger. Therefore, here, the enthalpy of the main refrigerant that is sent to the main heat-source-side heat exchanger is increased, and the heat-exchange amount required to evaporate the main refrigerant at the main heat-source-side heat exchanger can be decreased.

In this way, here, the refrigeration cycle device in which the injection pipe and the economizer heat exchanger are provided at the refrigerant circuit is capable of increasing the evaporation capacity of the usage-side heat exchanger when operating to cause the usage-side heat exchanger to function as the evaporator of the refrigerant, and is capable of decreasing the heat-exchange amount required to evaporate the refrigerant at the heat-source-side heat exchanger when operating to cause the usage-side heat exchanger to function as the radiator of the refrigerant.

A refrigeration cycle device according to a second aspect is the refrigeration cycle device according to the first aspect, in which the main compressor includes a low-stage-side compression element that compresses the main refrigerant and a high-stage-side compression element that compresses the main refrigerant discharged from the low-stage-side compression element. The main refrigerant circuit has an intermediate heat exchanger. When the main flow-path switching mechanism is in the main cooling operation state, the intermediate heat exchanger functions as a cooler of the main refrigerant that flows between the low-stage-side compression element and the high-stage-side compression element. When the main flow-path switching mechanism is in the main heating operation state, the intermediate heat exchanger functions as an evaporator of the main refrigerant that has been heated at the sub-usage-side heat exchanger.

Here, as described above, when the main flow-path switching mechanism is in the main cooling operation state, the intermediate heat exchanger is capable of cooling a main refrigerant at an intermediate pressure that flows between the low-stage-side compression element and the high-stage-side compression element. Therefore, it is possible to avoid rise in the temperature of a main refrigerant at a high pressure that is discharged from the main compressor. Moreover, here, as described above, when the main flow-path switching mechanism is in the main heating operation state, the intermediate heat exchanger is capable of evaporating a main refrigerant that has been heated at the sub-usage-side heat exchanger. Therefore, it is possible to increase the evaporation capacity compared with that when the main refrigerant that has been heated at the sub-usage-side heat exchanger is evaporated by only the main heat-source-side heat exchanger.

A refrigeration cycle device according to a third aspect is the refrigeration cycle device according to the first aspect, in which the main compressor includes a compression element having an intermediate injection port to which the main refrigerant is introduced from outside in a midway portion of the compression stroke. The injection pipe is connected to the intermediate injection port.

Here, it is possible to send the main refrigerant that flows in the injection pipe to a midway portion (the intermediate injection port) of the compression stroke of the main compressor, which is a single-stage compressor. Therefore, the main compressor is capable of lowering the temperature of the main refrigerant that has been compressed to the intermediate pressure in the refrigeration cycle.

A refrigeration cycle device according to a fourth aspect is the refrigeration cycle device according to the first aspect or the second aspect, in which the main compressor includes a low-stage-side compression element that compresses the main refrigerant and a high-stage-side compression element that compresses the main refrigerant discharged from the low-stage-side compression element. The injection pipe is connected on a suction side of the high-stage-side compression element.

Here, it is possible to send the main refrigerant that flows in the injection pipe to a midway portion (location between the low-stage-side compression element and the high-stage-side compression element) of a compression stroke of the main compressor, which is a multi-stage compressor. Therefore, the main compressor is capable of lowering the temperature of the main refrigerant that has been compressed to the intermediate pressure in the refrigeration cycle.

A refrigeration cycle device according to a fifth aspect is the refrigeration cycle device according to any one of the first aspect to the fourth aspect, in which the main refrigerant circuit has a main expansion mechanism between the economizer heat exchanger and the sub-usage-side heat exchanger.

Here, when the cooling operation is performed and when the heating operation is performed, it is possible to cause a main refrigerant that has not yet been decompressed at the main expansion mechanism to flow in the economizer heat exchanger. Therefore, it is possible to increase the cooling capacity of the main refrigerant at the economizer heat exchanger.

A refrigeration cycle device according to a sixth aspect is the refrigeration cycle device according to the fifth aspect, further includes a control unit that controls a constituent device of the main refrigerant circuit and a constituent device of the sub-refrigerant circuit. The control unit controls the constituent device of the main refrigerant circuit and the constituent device of the sub-refrigerant circuit so that the main refrigerant circuit and the sub-refrigerant circuit are interlocked.

When the sub-refrigerant circuit is controlled independently of the main refrigerant circuit, in performing the cooling operation, the balance between the cooling heat amount of the main refrigerant at the economizer heat exchanger and the cooling heat amount of a main refrigerant at the sub-usage-side heat exchanger may be lost. In addition, in performing the heating operation, the balance between the flow rate of the main refrigerant that flows in the injection pipe and the heating heat amount of the main refrigerant at the sub-usage-side heat exchanger may be lost.

Therefore, here, as described above, by controlling the constituent device of the main refrigerant circuit and the constituent device of the sub-refrigerant circuit so that the main refrigerant circuit and the sub-refrigerant circuit are interlocked, the cooling heat amount of the main refrigerant at the economizer heat exchanger and the cooling heat amount of the main refrigerant at the sub-usage-side heat exchanger are suitably balanced when performing the cooling operation, and the flow rate of the main refrigerant that flows in the injection pipe and the heating heat amount of the main refrigerant at the sub-usage-side heat exchanger can be suitably balanced when performing the heating operation.

A refrigeration cycle device according to a seventh aspect is the refrigeration cycle device according to the sixth aspect, in which the injection pipe has an injection expansion mechanism. The control unit controls the injection expansion mechanism and the constituent device of the sub-refrigerant circuit based on a coefficient of performance of the main refrigerant circuit.

Here, as described above, in performing control to cause the main refrigerant circuit and the sub-refrigerant circuit to be interlocked, the injection expansion mechanism and the constituent device of the sub-refrigerant circuit are controlled based on the coefficient of performance of the main refrigerant circuit. Therefore, here, in performing the cooling operation, the cooling heat amount of the main refrigerant at the economizer heat exchanger and the cooling heat amount of the main refrigerant at the sub-usage-side heat exchanger can be balanced based on the coefficient of performance of the main refrigerant circuit; and, in performing the heating operation, the flow rate of the main refrigerant that flows in the injection pipe and the heating heat amount of the main refrigerant at the sub-usage-side heat exchanger can be balanced based on the coefficient of performance of the main refrigerant circuit.

A refrigeration cycle device according to an eighth aspect is the refrigeration cycle device according to the seventh aspect, in which, when the main flow-path switching mechanism is in the main cooling operation state and the sub-flow-path switching mechanism is in the sub-cooling operation state, the control unit controls the constituent device of the sub-refrigerant circuit based on the coefficient of performance of the main refrigerant circuit with an opening degree of the injection expansion mechanism being controlled so that a temperature of the main refrigerant at an inlet of the main expansion mechanism becomes a first main refrigerant target temperature.

Here, when performing the cooling operation, in controlling the injection expansion mechanism and the constituent device of the sub-refrigerant circuit based on the coefficient of performance of the main refrigerant circuit, the injection expansion mechanism is controlled based on the temperature of the main refrigerant at the inlet of the main expansion mechanism to make it possible to balance the cooling heat amount of the main refrigerant at the sub-usage-side heat exchanger while ensuring the cooling heat amount of the main refrigerant at the economizer heat exchanger.

A refrigeration cycle device according to a ninth aspect is the refrigeration cycle device according to the seventh aspect, in which, when the main flow-path switching mechanism is in the main cooling operation state and the sub-flow-path switching mechanism is in the sub-cooling operation state, the control unit controls the constituent device of the sub-refrigerant circuit based on the coefficient of performance of the main refrigerant circuit with an opening degree of the injection expansion mechanism being controlled so that a superheating degree of the main refrigerant that flows in the injection pipe at an outlet of the economizer heat exchanger becomes a first main refrigerant target superheating degree.

Here, when performing the cooling operation, in controlling the injection expansion mechanism and the constituent device of the sub-refrigerant circuit based on the coefficient of performance of the main refrigerant circuit, the injection expansion mechanism is controlled based on the superheating degree of the main refrigerant that flows in the injection pipe at the outlet of the economizer heat exchanger to make it possible to balance the cooling heat amount of the main refrigerant at the sub-usage-side heat exchanger while ensuring the cooling heat amount of the main refrigerant at the economizer heat exchanger.

A refrigeration cycle device according to a tenth aspect is the refrigeration cycle device according to the eighth aspect or the ninth aspect, in which, in accordance with a correlation between the temperature of the main refrigerant at the inlet of the main expansion mechanism, the coefficient of performance of the main refrigerant circuit, and a temperature of the sub-refrigerant at an outlet of the sub-usage-side heat exchanger, the control unit sets a first sub-refrigerant target temperature, which is a target value of the temperature of the sub-refrigerant at the outlet of the sub-usage-side heat exchanger, to control the constituent device of the sub-refrigerant circuit so that the temperature of the sub-refrigerant at the outlet of the sub-usage-side heat exchanger becomes the first sub-refrigerant target temperature.

Here, when performing the cooling operation, in controlling the constituent devices of the sub-refrigerant circuit based on the coefficient of performance of the main refrigerant circuit, the sub-refrigerant circuit is controlled so that the temperature of the sub-refrigerant at the outlet of the sub-usage-side heat exchanger becomes the first sub-refrigerant target temperature that is obtained based on the temperature of the main refrigerant at the inlet of the main expansion mechanism and the coefficient of performance of the main refrigerant circuit, to make it possible to balance the cooling heat amount of the main refrigerant at the sub-usage-side heat exchanger.

A refrigeration cycle device according to an eleventh aspect is the refrigeration cycle device according to any one of the seventh aspect to the tenth aspect, in which, when the main flow-path switching mechanism is in the main heating operation state and the sub-flow-path switching mechanism is in the sub-heating operation state, the control unit controls the constituent device of the sub-refrigerant circuit based on the coefficient of performance of the main refrigerant circuit with the opening degree of the injection expansion mechanism being controlled so that the temperature of the main refrigerant at the inlet of the main expansion mechanism becomes a second main refrigerant target temperature.

Here, when performing the heating operation, in controlling the injection expansion mechanism and the constituent device of the sub-refrigerant circuit based on the coefficient of performance of the main refrigerant circuit, the injection expansion mechanism is controlled based on the temperature of the main refrigerant at the inlet of the main expansion mechanism to make it possible to balance the heating heat amount of the main refrigerant at the sub-usage-side heat exchanger while ensuring the flow rate of the main refrigerant that flows in the injection pipe.

A refrigeration cycle device according to a twelfth aspect is the refrigeration cycle device according to any one of the seventh aspect to the tenth aspect, in which, when the main flow-path switching mechanism is in the main heating operation state and the sub-flow-path switching mechanism is in the sub-heating operation state, the control unit controls the constituent device of the sub-refrigerant circuit based on the coefficient of performance of the main refrigerant circuit with the opening degree of the injection expansion mechanism being controlled so that the superheating degree of the main refrigerant that flows in the injection pipe at the outlet of the economizer heat exchanger becomes a second main refrigerant target superheating degree.

Here, when performing the heating operation, in controlling the injection expansion mechanism and the constituent device of the sub-refrigerant circuit based on the coefficient of performance of the main refrigerant circuit, the injection expansion mechanism is controlled based on the superheating degree of the main refrigerant that flows in the injection pipe at the outlet of the economizer heat exchanger to make it possible to balance the heating heat amount of the main refrigerant at the sub-usage-side heat exchanger while ensuring the flow rate of the main refrigerant that flows in the injection pipe.

A refrigeration cycle device according to a thirteenth aspect is the refrigeration cycle device according to the eleventh aspect or the twelfth aspect, in which, in accordance with the correlation between the temperature of the main refrigerant at the inlet of the main expansion mechanism, the coefficient of performance of the main refrigerant circuit, and the temperature of the sub-refrigerant at the outlet of the sub-usage-side heat exchanger, the control unit sets a second sub-refrigerant target temperature, which is a target value of the temperature of the sub-refrigerant at the outlet of the sub-usage-side heat exchanger, to control the constituent device of the sub-refrigerant circuit so that the temperature of the sub-refrigerant at the outlet of the sub-usage-side heat exchanger becomes the second sub-refrigerant target temperature.

Here, when performing the heating operation, in controlling the constituent device of the sub-refrigerant circuit based on the coefficient of performance of the main refrigerant circuit, the sub-refrigerant circuit is controlled so that the temperature of the sub-refrigerant at the outlet of the sub-usage-side heat exchanger becomes the second sub-refrigerant target temperature that is obtained based on the temperature of the main refrigerant at the inlet of the main expansion mechanism and the coefficient of performance of the main refrigerant circuit, to make it possible to balance the heating heat amount of the main refrigerant at the sub-usage-side heat exchanger.

A refrigeration cycle device according to a fourteenth aspect is the refrigeration cycle device according to any one of the first aspect to the thirteenth aspect, in which the main refrigerant is carbon dioxide, and in which the sub-refrigerant is a HFC refrigerant, a HFO refrigerant, or a mixture refrigerant in which the HFC refrigerant and the HFO refrigerant are mixed. Each of the HFC refrigerant, the HFO refrigerant, and the mixture refrigerant has a GWP that is 750 or less.

Here, as described above, since, in addition to the main refrigerant and the sub-refrigerant, a refrigerant having a low GWP is used, it is possible to reduce environmental load, such as global warming.

A refrigeration cycle device according to a fifteenth aspect is the refrigeration cycle device according to any one of the first aspect to the thirteenth aspect, in which the main refrigerant is carbon dioxide, and in which the sub-refrigerant is a natural refrigerant having a coefficient of performance that is higher than a coefficient of performance of carbon dioxide.

Here, as described above, since, as the sub-refrigerant, a natural refrigerant having a coefficient of performance that is higher than that of carbon dioxide is used, it is possible to reduce environmental load, such as global warming.

DESCRIPTION OF EMBODIMENTS

A refrigeration cycle device is described below based on the drawings.

(1) Configuration

Figure 1:
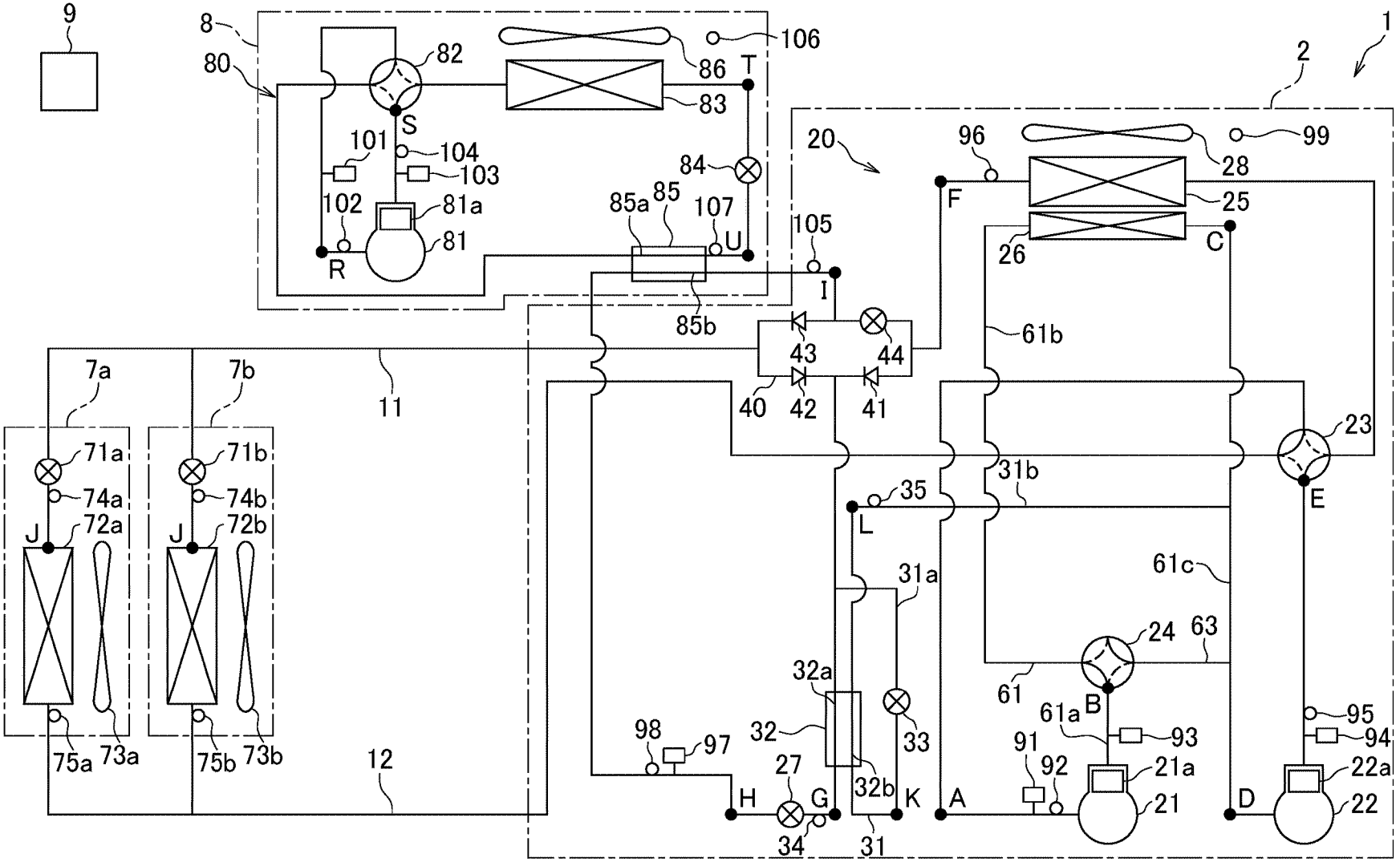
FIG. 1 is a schematic view of a configuration of a refrigeration cycle device according to an embodiment of the present disclosure.

FIG. 1 is a schematic view of a configuration of a refrigeration cycle device 1 according to an embodiment of the present disclosure.

<Circuit Configuration>

The refrigeration cycle device 1 includes a main refrigerant circuit 20 in which a main refrigerant circulates and a sub-refrigerant circuit 80 in which a sub-refrigerant circulates, and is a device that air-conditions (here, cools and heats) the interior of a room.

—Main Refrigerant Circuit—

The main refrigerant circuit 20 primarily has main compressors 21 and 22, a main heat-source-side heat exchanger 25, main usage-side heat exchangers 72*a* and 72*b*, an injection pipe 31, an economizer heat exchanger 32, a sub-usage-side heat exchanger 85, and a first main flow-path switching mechanism 23. The main refrigerant circuit 20 has an intermediate refrigerant pipe 61, a second main flow-path switching mechanism 24, an intermediate heat exchanger 26, an intermediate heat-exchange bypass pipe 63, a bridge circuit 40, an upstream-side main expansion mechanism 27, and main usage-side expansion mechanisms 71*a* and 71*b*. As the main refrigerant, carbon dioxide is sealed in the main refrigerant circuit 20.

The main compressors 21 and 22 are devices that compress the main refrigerant. The first main compressor 21 is a compressor in which a low-stage-side compression element 21*a*, such as a rotary type or a scroll type, is driven by a driving mechanism, such as a motor or an engine. The second main compressor 22 is a compressor in which a high-stage-side compression element 22*a*, such as a rotary type or a scroll type, is driven by a driving mechanism, such as a motor or an engine. The main compressors 21 and 22 constitute a multi-stage compressor (here, a two-stage compressor) in which, at the first main compressor 21 on the low-stage side, the main refrigerant is compressed and then discharged, and in which, at the second main compressor 22 on the high-stage side, the main refrigerant discharged from the first main compressor 21 is compressed. Here, a discharge side of the first main compressor 21 (low-stage-side compression element 21*a*) and a suction side of the second main compressor 22 (high-stage-side compression element 22*a*) are connected by the intermediate refrigerant pipe 61.

The first main flow-path switching mechanism 23 is a mechanism for switching a direction of flow of the main refrigerant in the main refrigerant circuit 20. The first main flow-path switching mechanism 23 is a switching mechanism that switches between a main cooling operation state, in which the main refrigerant is caused to circulate so that the main usage-side heat exchangers 72*a* and 72*b* function as evaporators of the main refrigerant, and a main heating operation state, in which the main refrigerant is caused to circulate so that the main usage-side heat exchangers 72*a* and 72*b* function as radiators of the main refrigerant. Specifically, the first main flow-path switching mechanism 23 is a four-way switching valve, and, here, is connected to the suction side of the main compressor 21 or 22 (here, the suction side of the first main compressor 21), a discharge side of the main compressor 21 or 22 (here, the discharge side of the second main compressor 22), one end of the main heat-source-side heat exchanger 25, and the other ends of the main usage-side heat exchangers 72*a* and 72*b*. In addition, the first main flow-path switching mechanism 23 is, in the main cooling operation state, connected to the discharge side of the second main compressor 22 and the one end of the main heat-source-side heat exchanger 25, and connected to the suction side of the first main compressor 21 and the other ends of the main usage-side heat exchangers 72*a* and 72*b* (refer to a solid line of the first main flow-path switching mechanism 23 in FIG. 1). In addition, the first main flow-path switching mechanism 23 is, in the main heating operation state, connected to the discharge side of the second main compressor 22 and the other ends of the main usage-side heat exchangers 72*a* and 72*b*, and connected to the suction side of the first main compressor 21 and the one end of the main heat-source-side heat exchanger 25 (refer to a broken line of the first main flow-path switching mechanism 23 in FIG. 1). Note that the first main flow-path switching mechanism 23 is not limited to a four-way switching valve, and, for example, may have the function of switching a direction of flow of the main refrigerant as described above by, for example, combining a plurality of two-way valves or three-way valves.

The main heat-source-side heat exchanger 25 is a device that causes the main refrigerant and outdoor air to exchange heat with each other, and, here, is a heat exchanger that functions as a radiator or an evaporator of the main refrigerant. The one end of the main heat-source-side heat exchanger 25 is connected to the first main flow-path switching mechanism 23, and the other end of the main heat-source-side heat exchanger 25 is connected to the bridge circuit 40. In addition, when the first main flow-path switching mechanism 23 is in the main cooling operation state, the main heat-source-side heat exchanger 25 functions as a radiator (a heat dissipater) of the main refrigerant, and when the first main flow-path switching mechanism 23 is in the main heating operation state, the main heat-source-side heat exchanger 25 functions as an evaporator of the main refrigerant.

The bridge circuit 40 is provided between the main heat-source-side heat exchanger 25 and the main usage-side heat exchangers 72*a* and 72*b*. The bridge circuit 40 is a circuit that regulates flow so that, when the first main flow-path switching mechanism 23 is in the main cooling operation state and when the first main flow-path switching mechanism 23 is in the main heating operation state, the main refrigerant that circulates in the main refrigerant circuit 20 flows in the economizer heat exchanger 32 (a first economizer flow path 32*a*), the upstream-side main expansion mechanism 27, and the sub-usage-side heat exchanger 85 (a second sub-flow-path 85*b*) in this order. Here, the bridge circuit 40 has three check mechanisms 41, 42, and 43, and a downstream-side main expansion mechanism 44. Here, the inlet check mechanism 41 is a check valve that allows only flow of the main refrigerant to the economizer heat exchanger 32 and the upstream-side main expansion mechanism 27 from the main heat-source-side heat exchanger 25. The inlet check mechanism 42 is a check valve that allows only flow of the main refrigerant to the economizer heat exchanger 32 and the upstream-side main expansion mechanism 27 from the main usage-side heat exchangers 72*a* and 72*b*. The outlet check mechanism 43 is a check valve that allows only flow of the main refrigerant to the main usage-side heat exchangers 72*a* and 72*b* from the sub-usage-side heat exchanger 85. The downstream-side main expansion mechanism 44 is a device that decompresses the main refrigerant, and, here, is an expansion mechanism that is fully closed when the first main flow-path switching mechanism 23 is in the main cooling operation state, and that decompresses the main refrigerant that is sent to the main heat-source-side heat exchanger 25 from the sub-usage-side heat exchanger 85 when the first main flow-path switching mechanism 23 is in the main heating operation state. The downstream-side main expansion mechanism 44 is, for example, an electrically powered expansion valve.

The injection pipe 31 is a refrigerant pipe in which the main refrigerant flows, and, here, is a refrigerant pipe that causes the main refrigerant that flows between the main heat-source-side heat exchanger 25 and the main usage-side heat exchangers 72*a* and 72*b* to branch off and to be sent to the main compressors 21 and 22. Specifically, the injection pipe 31 is a refrigerant pipe that causes a main refrigerant that flows between the inlet check mechanisms 41 and 42 of the bridge circuit 40 and the upstream-side main expansion mechanism 27 to branch off and to be sent to the suction side of the second main compressor 22, and includes a first injection pipe 31*a* and a second injection pipe 31*b*. One end of the first injection pipe 31*a* is connected at a location between the inlet check mechanisms 41 and 42 of the bridge circuit 40 and the economizer heat exchanger 32 (one end of the first economizer flow path 32*a*), and the other end of the first injection pipe 31*a* is connected to the economizer heat exchanger 32 (one end of a second economizer flow path 32*b*). One end of the second injection pipe 31*b* is connected to the economizer heat exchanger 32 (the other end of the second economizer flow path 32*b*), and the other end of the second injection pipe 31*b* is connected at a location between an outlet of the intermediate heat exchanger 26 and the suction side of the second main compressor 22.

The injection pipe 31 has an injection expansion mechanism 33. The injection expansion mechanism 33 is provided at the first injection pipe 31*a*. The injection expansion mechanism 33 is a device that decompresses the main refrigerant, and, here, is an expansion mechanism that decompresses a main refrigerant that flows in the injection pipe 31. The injection expansion mechanism 33 is, for example, an electrically powered expansion valve.

The economizer heat exchanger 32 is a device that causes main refrigerants to exchange heat with each other, and, here, is a heat exchanger that cools a main refrigerant that flows between the main heat-source-side heat exchanger 25 and the main usage-side heat exchangers 72*a* and 72*b* by heat exchange with the main refrigerant that flows in the injection pipe 31. Specifically, the economizer heat exchanger 32 is a heat exchanger that cools the main refrigerant that flows between the inlet check mechanisms 41 and 42 of the bridge circuit 40 and the upstream-side main expansion mechanism 27 by heat exchange with the main refrigerant that flows in the injection pipe 31. The economizer heat exchanger 32 has the first economizer flow path 32*a* in which the main refrigerant that flows between the inlet check mechanisms 41 and 42 of the bridge circuit 40 and the upstream-side main expansion mechanism 27 is caused to flow, and the second economizer flow path 32*b* in which the main refrigerant that flows in the injection pipe 31 is caused to flow. The one end (inlet) of the first economizer flow path 32*a* is connected to the inlet check mechanisms 41 and 42 of the bridge circuit 40, and the other end (outlet) of the first economizer flow path 32*a* is connected to an inlet of the upstream-side main expansion mechanism 27. The one end (inlet) of the second economizer flow path 32*b* is connected to the other end of the first injection pipe 31*a*, and the other end (outlet) of the second economizer flow path 32*b* is connected to the one end of the second injection pipe 31*b*.

The upstream-side main expansion mechanism 27 is a device that decompresses the main refrigerant, and, here, is an expansion mechanism (main expansion mechanism) that decompresses a main refrigerant that flows between the economizer heat exchanger 32 and the sub-usage-side heat exchanger 85 (the second sub-flow path 85*b*). Specifically, the upstream-side main expansion mechanism 27 is provided between the inlet check mechanisms 41 and 42 of the bridge circuit 40 and the sub-usage-side heat exchanger 85 (the second sub-flow path 85*b*). The upstream-side main expansion mechanism 27 is, for example, an electrically powered expansion valve. Note that the upstream-side main expansion mechanism 27 may be an expander that causes power to be produced by decompressing the main refrigerant.

The sub-usage-side heat exchanger 85 is a device that causes the main refrigerant and the sub-refrigerant to exchange heat with each other, and, here, is a heat exchanger that functions as a cooler or a heater of a main refrigerant that has been cooled at the economizer heat exchanger 31. That is, when the first main flow-path switching mechanism 23 is in the main cooling operation state, the sub-usage-side heat exchanger 85 functions as a cooler of the main refrigerant that has been cooled at the economizer heat exchanger 31, and when the first main flow-path switching mechanism 23 is in the main heating operation state, the sub-usage-side heat exchanger 85 functions as a heater of the main refrigerant that has been cooled at the economizer heat exchanger 31. Specifically, the sub-usage-side heat exchanger 85 is a heat exchanger that cools or heats a main refrigerant that flows between the upstream-side main expansion mechanism 27 and the third check mechanism 43 and the downstream-side main expansion mechanism 44 of the bridge circuit 40.

The main usage-side expansion mechanisms 71*a* and 71*b* are each a device that decompresses the main refrigerant. Here, the main usage-side expansion mechanisms 71*a* and 71*b* are expansion mechanisms that decompress the main refrigerant that flows between the sub-usage-side heat exchanger 85 and the main usage-side heat exchangers 72*a* and 72*b* when the first main flow-path switching mechanism 23 is in the main cooling operation state, and that decompresses the main refrigerant that flows between the main usage-side heat exchangers 72*a* and 72*b* and the upstream-side main expansion mechanism 27 when the first main flow-path switching mechanism 23 is in the main heating operation state. Specifically, the main usage-side expansion mechanisms 71*a* and 71*b* are provided between the inlet check mechanism 42 and the outlet check mechanism 43 of the bridge circuit 40 and one ends of the corresponding main usage-side heat exchangers 72*a* and 72*b*. The main usage-side expansion mechanisms 71*a* and 71*b* are each, for example, an electrically powered expansion valve.

The main usage-side heat exchangers 72*a* and 72*b* are each a device that causes the main refrigerant and indoor air to exchange heat with each other, and, here, are each a heat exchanger that functions as an evaporator or a radiator of the main refrigerant. The one end of each of the main usage-side heat exchangers 72*a* and 72*b* is connected to a corresponding one of the main usage-side expansion mechanisms 71*a* and 71*b*, and the other end of each of the main usage-side heat exchangers 72*a* and 72*b* is connected to the suction side of the first compressor 21.

The intermediate heat exchanger 26 is a device that causes the main refrigerant and outdoor air to exchange heat with each other, and, here, is a heat exchanger that functions as a cooler of a main refrigerant that flows between the first main compressor 21 and the second main compressor 22 when the first main flow-path switching mechanism 23 is in the main cooling operation state. In addition, the intermediate heat exchanger 26 is a heat exchanger that functions as an evaporator of a main refrigerant that has been heated at the sub-usage-side heat exchanger 85 (the second sub-flow path 85*b*) when the first main flow-path switching mechanism 23 is in the main heating operation state. The intermediate heat exchanger 26 is provided at the intermediate refrigerant pipe 61.

The intermediate refrigerant pipe 61 includes a first intermediate refrigerant pipe 61*a*, a second intermediate refrigerant pipe 61*b*, and a third intermediate refrigerant pipe 61*c*. One end of the first intermediate refrigerant pipe 61*a* is connected to the discharge side of the first main compressor 21 (the low-stage-side compression element 21*a*), and the other end of the first intermediate refrigerant pipe 61*a* is connected to the second main flow-path switching mechanism 24. One end of the second intermediate refrigerant pipe 61*b* is connected to the second main flow-path switching mechanism 24, and the other end of the second intermediate refrigerant pipe 61*b* is connected to one end of the intermediate heat exchanger 26. One end of the third intermediate refrigerant pipe 61*c* is connected to the other end of the intermediate heat exchanger 26, and the other end of the third intermediate refrigerant pipe 61*c* is connected to the suction side of the second main compressor 22 (the high-stage-side compression element 22*a*). In addition, the other end of the second intermediate injection pipe 31*b* is connected to the third intermediate refrigerant pipe 61*c*.

The intermediate heat-exchange bypass pipe 63 is a refrigerant pipe that causes the main refrigerant that has been discharged from the first main compressor 21 (the low-stage-side compression element 21*a*) to bypass the intermediate heat exchanger 26 and to be sent to the second main compressor 22 (the high-stage-side compression element 22*a*) when the first main flow-path switching mechanism 23 is in the main heating operation state. One end of the intermediate heat-exchange bypass pipe 63 is connected to the second main flow-path switching mechanism 24, and the other end of the intermediate heat-exchange bypass pipe 63 is connected to a portion between the third intermediate refrigerant pipe 61*c* and the suction side of the second main compressor 22 (the high-stage-side compression element 22*a*).

The second main flow-path switching mechanism 24 is a mechanism for switching a direction of flow of the main refrigerant in the main refrigerant circuit 20. The second main flow-path switching mechanism 24 is a switching mechanism that switches between an intermediate heat-exchange heat dissipation state, in which the main refrigerant that has been discharged from the first main compressor 21 is passed through the intermediate heat exchanger 26 and then is sent to the second main compressor 22, and an intermediate heat-exchange bypass state, in which the main refrigerant that has been discharged from the first main compressor 21 is sent to the second main compressor 22 without passing through the intermediate heat exchanger 26. Specifically, the second main flow-path switching mechanism 24 is a four-way switching valve, and is connected to the discharge side of the first main compressor 21, the one end of the second intermediate refrigerant pipe 61*b*, and the one end of the intermediate heat-exchange bypass pipe 63. In addition, in the intermediate heat-exchange heat dissipation state, the second main flow-path switching mechanism 24 connects the discharge side of the first main compressor 21 and the suction side of the second main compressor 22 via the intermediate heat exchanger 26 (refer to a solid line of the second main flow-path switching mechanism 24 in FIG. 1). In the intermediate heat-exchange bypass state, the second main flow-path switching mechanism 24 connects the discharge side of the first main compressor 21 and the suction side of the second main compressor 22 via the intermediate heat-exchange bypass pipe 64 (refer to a broken line of the second main flow-path switching mechanism 24 in FIG. 1). Note that the second main flow-path switching mechanism 24 is not limited to a four-way switching valve, and, for example, may have the function of switching a direction of flow of the main refrigerant as described above by, for example, combining a plurality of two-way valves or three-way valves.

In addition, in the main refrigerant circuit 20, when the first main flow-path switching mechanism 23 is in the main cooling operation state and the second main flow-path switching mechanism 24 is in the intermediate heat-exchange heat dissipation state, the main refrigerant that has been discharged from the first main compressor 21 can flow so as to be sucked into the second main compressor 22 after being cooled at the intermediate heat exchanger 26. In addition, in the main refrigerant circuit 20, when the first main flow-path switching mechanism 23 is in the main heating operation state and the second main flow-path switching mechanism 24 is in the intermediate heat-exchange bypass state, the main refrigerant that has been discharged from the first main compressor 21 can flow so as to bypass the intermediate heat exchanger 26 via the intermediate heat-exchange bypass pipe 63 and to be sucked into the second main compressor 22.

—Sub-Refrigerant Circuit—

The sub-refrigerant circuit 80 primarily has a sub-compressor 81, a sub-heat-source-side heat exchanger 83, the sub-usage-side heat exchanger 85, and a sub-flow-path switching mechanism 82. The sub-refrigerant circuit 80 has a sub-expansion mechanism 84. As the sub-refrigerant, a HFC refrigerant (such as R32), a HFO refrigerant (such as R1234yf or R1234ze), or a mixture refrigerant in which the HFC refrigerant and the HFO refrigerant are mixed (such as R452B) is sealed in the sub-refrigerant circuit 80. Each of the HFC refrigerant, the HFO refrigerant, and the mixture refrigerant having a GWP (global warming potential) is 750 or less. Note that the sub-refrigerant is not limited thereto, and may be a natural refrigerant having a coefficient of performance that is higher than that of carbon dioxide (such as propane or ammonia).

The sub-compressor 81 is a device that compresses the sub-refrigerant. The sub-compressor 81 is a compressor in which a compression element 81*a*, such as a rotary type or a scroll type, is driven by a driving mechanism, such as a motor or an engine.

The sub-flow-path switching mechanism 82 is a mechanism for switching a direction of flow of the sub-refrigerant in the sub-refrigerant circuit 80. The sub-flow-path switching mechanism 82 is a switching mechanism that switches between a sub-cooling operation state, in which the sub-refrigerant is caused to circulate so that the sub-usage-side heat exchanger 85 functions as an evaporator of the sub-refrigerant, and a sub-heating operation state, in which the sub-refrigerant is caused to circulate so that the sub-usage-side heat exchanger 85 functions as a radiator of the sub-refrigerant. Specifically, the sub-flow-path switching mechanism 82 is a four-way switching valve, and is connected to a suction side of the sub-compressor 81, a discharge side of the sub-compressor 81, one end of the sub-heat-source-side heat exchanger 83, and the other end of the sub-usage-side heat exchanger 85 (a first sub-flow path 85*a*). In addition, the sub-flow-path switching mechanism 82 is, in the sub-cooling operation state, connected to the discharge side of the sub-compressor 81 and the one end of the sub-heat-source-side heat exchanger 83, and connected to the suction side of the sub-compressor 81 and the other end of the sub-usage-side heat exchanger 85 (the first sub-flow path 85*a*) (refer to a solid line of the sub-flow-path switching mechanism 82 in FIG. 1). In addition, the sub-flow-path switching mechanism 82 is, in the sub-heating operation state, connected to the discharge side of the sub-compressor 81 and the other end of the sub-usage-side heat exchanger 85 (the first sub-flow path 85*a*), and connected to the suction side of the sub-compressor 81 and the one end of the sub-heat-source-side heat exchanger 83 (refer to a broken line of the sub-flow-path switching mechanism 82 in FIG. 1). Note that the sub-flow-path switching mechanism 82 is not limited to a four-way switching valve, and, for example, may have the function of switching a direction of flow of the sub-refrigerant as described above by, for example, combining a plurality of two-way valves or three-way valves.

The sub-heat-source-side heat exchanger 83 is a device that causes the sub-refrigerant and outdoor air to exchange heat with each other, and, here, is a heat exchanger that functions as a radiator or an evaporator of the sub-refrigerant. The one end of the sub-heat-source-side heat exchanger 83 is connected to the sub-flow-path switching mechanism 82, and the other end of the sub-heat-source-side heat exchanger 83 is connected to the sub-expansion mechanism 84. In addition, when the sub-flow-path switching mechanism 82 is in the sub-cooling operation state, the sub-heat-source-side heat exchanger 83 functions as a radiator of the sub-refrigerant, and when the sub-flow-path switching mechanism 82 is in the sub-heating operation state, the sub-heat-source-side heat exchanger 83 functions as an evaporator of the sub-refrigerant.

The sub-expansion mechanism 84 is a device that decompresses the sub-refrigerant, and, here, is an expansion mechanism that decompresses a sub-refrigerant that flows between the sub-heat-source-side heat exchanger 83 and the sub-usage-side heat exchanger 85. Specifically, the sub-expansion mechanism 84 is provided between the other end of the sub-heat-source-side heat exchanger 83 and the sub-usage-side heat exchanger 85 (one end of the first sub-flow path 85*a*). The sub-expansion mechanism 84 is, for example, an electrically powered expansion valve.

The sub-usage-side heat exchanger 85 is, as described above, a device that causes the main refrigerant and the sub-refrigerant to exchange heat with each other, and, here, is a heat exchanger that functions as an evaporator of the sub-refrigerant and cools the main refrigerant that has been cooled at the economizer heat exchanger 32, or functions as a radiator of the sub-refrigerant and heats the main refrigerant that has been cooled at the economizer heat exchanger 32. Specifically, the sub-usage-side heat exchanger 85 is a heat exchanger that cools or heats a main refrigerant that flows between the upstream-side main expansion mechanism 27 and the third check mechanism 43 and the first downstream-side main expansion mechanism 44 of the bridge circuit 40 with a refrigerant that flows in the sub-refrigerant circuit 80. The sub-usage-side heat exchanger 85 has the first sub-flow path 85*a* in which the sub-refrigerant that flows between the sub-expansion mechanism 84 and the sub-flow-path switching mechanism 82 is caused to flow, and the second sub-flow path 85*b* in which the main refrigerant that flows between a gas-liquid separator 51 and the third check mechanism 43 and the first downstream-side main expansion mechanism 44 of the bridge circuit 40 is caused to flow. The one end of the first sub-flow path 85*a* is connected to the sub-expansion mechanism 84, and the other end of the first sub-flow path 85*a* is connected to the sub-flow-path switching mechanism 82. One end (inlet) of the second sub-flow path 85*b* is connected to the upstream-side main expansion mechanism 27, and the other end (outlet) of the second sub-flow path 85*b* is connected to the third check mechanism 43 and the first downstream-side main expansion mechanism 44 of the bridge circuit 40.

<Unit Configuration>

The constituent devices of the main refrigerant circuit 20 and the sub-refrigerant circuit 80 above are provided at a heat-source unit 2, a plurality of usage units 7*a* and 7*b*, and a sub-unit 8. The usage units 7*a* and 7*b* are each provided in correspondence with a corresponding one of the main usage-side heat exchangers 72*a* and 72*b*.

—Heat-Source Unit—

The heat-source unit 2 is disposed outdoors. The main refrigerant circuit 20 excluding the sub-usage-side heat exchanger 85, the main usage-side expansion mechanisms 71*a* and 71*b*, and the main usage-side heat exchangers 72*a* and 72*b* is provided at the heat-source unit 2.

A heat-source-side fan 28 for sending outdoor air to the main heat-source-side heat exchanger 25 and the intermediate heat exchanger 26 is provided at the heat-source unit 2. The heat-source-side fan 28 is a fan in which a blowing element, such as a propeller fan, is driven by a driving mechanism, such as a motor.

The heat-source unit 2 is provided with various sensors. Specifically, a pressure sensor 91 and a temperature sensor 92 that detect the pressure and the temperature of a main refrigerant on the suction side of the first main compressor 21 are provided. A pressure sensor 93 that detects the pressure of a main refrigerant on the discharge side of the first main compressor 21 is provided. A pressure sensor 94 and a temperature sensor 95 that detect the pressure and the temperature of a main refrigerant on the discharge side of the second main compressor 21 are provided. A temperature sensor 96 that detects the temperature of a main refrigerant on the other end side of the main heat-source-side heat exchanger 25 is provided. A temperature sensor 34 that detects the temperature of a main refrigerant on the other end side of the economizer heat exchanger 32 (the other end of the first economizer flow path 32*a*) is provided. A temperature sensor 35 that detects the temperature of a main refrigerant at the second injection pipe 31*b* is provided. A pressure sensor 97 and a temperature sensor 98 that detect the pressure and the temperature of a main refrigerant between the upstream-side main expansion mechanism 27 and the sub-usage-side heat exchanger 85 are provided. A temperature sensor 105 that detects the temperature of a main refrigerant on the other end side of the sub-usage-side heat exchanger 85 (the other end of the second sub-flow path 85*b*) is provided. A temperature sensor 99 that detects the temperature of outdoor air (outside air temperature) is provided.

—Usage Units—

The usage units 7*a* and 7*b* are disposed indoors. The main usage-side expansion mechanisms 71*a* and 71*b* and the main usage-side heat exchangers 72*a* and 72*b* of the main refrigerant circuit 20 are provided at a corresponding one of the usage units 7*a* and 7*b*.

Usage-side fans 73*a* and 73*b* for sending indoor air to a corresponding one of the main usage-side heat exchangers 72*a* and 72*b* are provided at a corresponding one of the usage units 7*a* and 7*b*. Each of the usage-side fans 73*a* and 73*b* is a fan in which a blowing element, such as a centrifugal fan or a multiblade fan, is driven by a driving mechanism, such as a motor.

The usage units 7*a* and 7*b* are provided with various sensors. Specifically, temperature sensors 74*a* and 74*b* that detect the temperature of a main refrigerant on one end side of a corresponding one of the main usage-side heat exchangers 72*a* and 72*b*, and temperature sensors 75*a* and 75*b* that detect the temperature of a main refrigerant on the other end side of a corresponding one of the main usage-side heat exchangers 72*a* and 72*b* are provided.

—Sub-Unit—

The sub-unit 8 is disposed outdoors. The sub-refrigerant circuit 80 and a part of a refrigerant pipe that constitutes the main refrigerant circuit 20 (a part of the refrigerant pipe that is connected to the sub-usage-side heat exchanger 85 and in which the main refrigerant flows) are provided at the sub-unit 8.

A sub-side fan 86 for sending outdoor air to the sub-heat-source-side heat exchanger 83 is provided at the sub-unit 8. The sub-side fan 86 is a fan in which a blowing element, such as a propeller fan, is driven by a driving mechanism, such as a motor.

Here, although the sub-unit 8 is provided adjacent to the heat-source unit 2 and the sub-unit 8 and the heat-source unit 2 are substantially integrated with each other, it is not limited thereto. The sub-unit 8 may be provided apart from the heat-source unit 2, or all constituent devices of the sub-unit 8 may be provided at the heat-source unit 2 and the sub-unit 8 may be omitted.

The sub-unit 8 is provided with various sensors. Specifically, a pressure sensor 101 and a temperature sensor 102 that detect the pressure and the temperature of a sub-refrigerant on the suction side of the sub-compressor 81 are provided. A pressure sensor 103 and a temperature sensor 104 that detect the pressure and the temperature of a sub-refrigerant on the discharge side of the sub-compressor 81 are provided. A temperature sensor 106 that detects the temperature of outdoor air (outside air temperature) is provided. A temperature sensor 107 that detects the temperature of a sub-refrigerant on one end side of the sub-usage-side heat exchanger 85 (the one end of the first sub-flow path 85*a*) is provided.

—Main Refrigerant Connection Pipes—

The heat-source unit 2 and the usage units 7*a* and 7*b* are connected to each other by main refrigerant connection pipes 11 and 12 that constitute a part of the main refrigerant circuit 20.

The first main refrigerant connection pipe 11 is a part of a pipe that connects the inlet check mechanism 42 and the outlet check mechanism 43 of the bridge circuit 40 and the main usage-side expansion mechanisms 71*a* and 71*b*.

The second main refrigerant connection pipe 12 is a part of a pipe that connects the other ends of the corresponding main usage-side heat exchangers 72*a* and 72*b* and the first main flow-path switching mechanism 23.

—Control Unit—

The constituent devices of the heat-source unit 2, the usage units 7*a* and 7*b*, and the sub-unit 8, including the constituent devices of the main refrigerant circuit 20 and the sub-refrigerant circuit 80 above, are controlled by a control unit 9. The control unit 9 is formed by communication-connection of, for example, a control board provided at the heat-source unit 2, the usage units 7*a* and 7*b*, and the sub-unit 8, and is formed so as to be capable of receiving, for example, detection signals of the various sensors 34, 35, 74*a*, 74*b*, 75*a*, 75*b*, 91 to 99, and 101 to 107. Note that, for convenience sake, FIG. 1 illustrates the control unit 9 at a position situated away from, for example, the heat-source unit 2, the usage units 7*a* and 7*b*, and the sub-unit 8. In this way, the control unit 9, based on, for example, the detection signals of, for example, the various sensors 34, 35, 74*a*, 74*b*, 75*a*, 75*b*, 91 to 99, and 101 to 107, controls the constituent devices 21 to 24, 27, 28, 33, 44, 71*a*, 71*b*, 73*a*, 73*b*, 81, 82, 84, and 86 of the refrigeration cycle device 1, that is, controls the operation of the entire refrigeration cycle device 1.

(2) Operation

Figure 2:
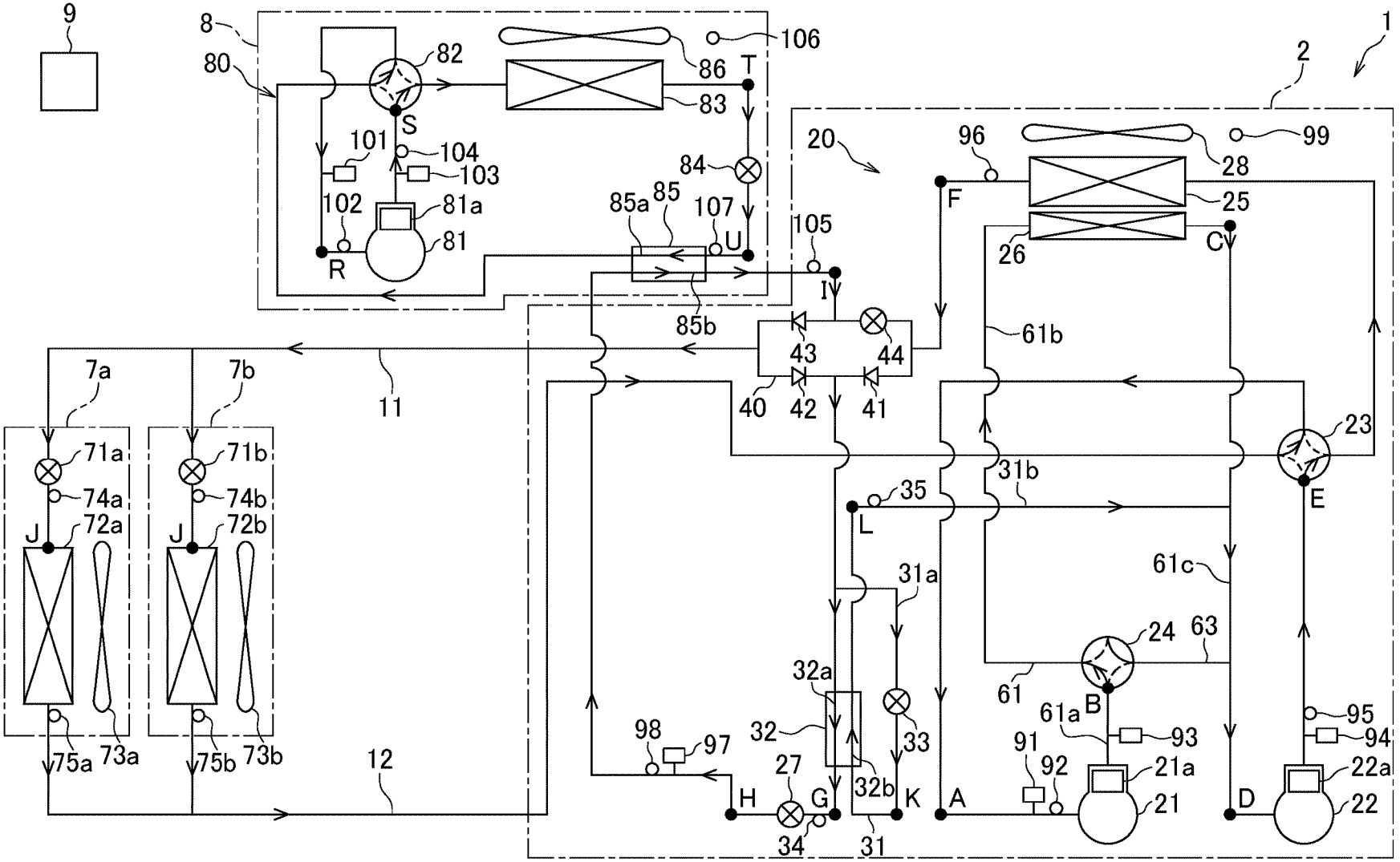
FIG. 2 illustrates flow of a refrigerant in the refrigeration cycle device in a cooling operation.
Figure 3:
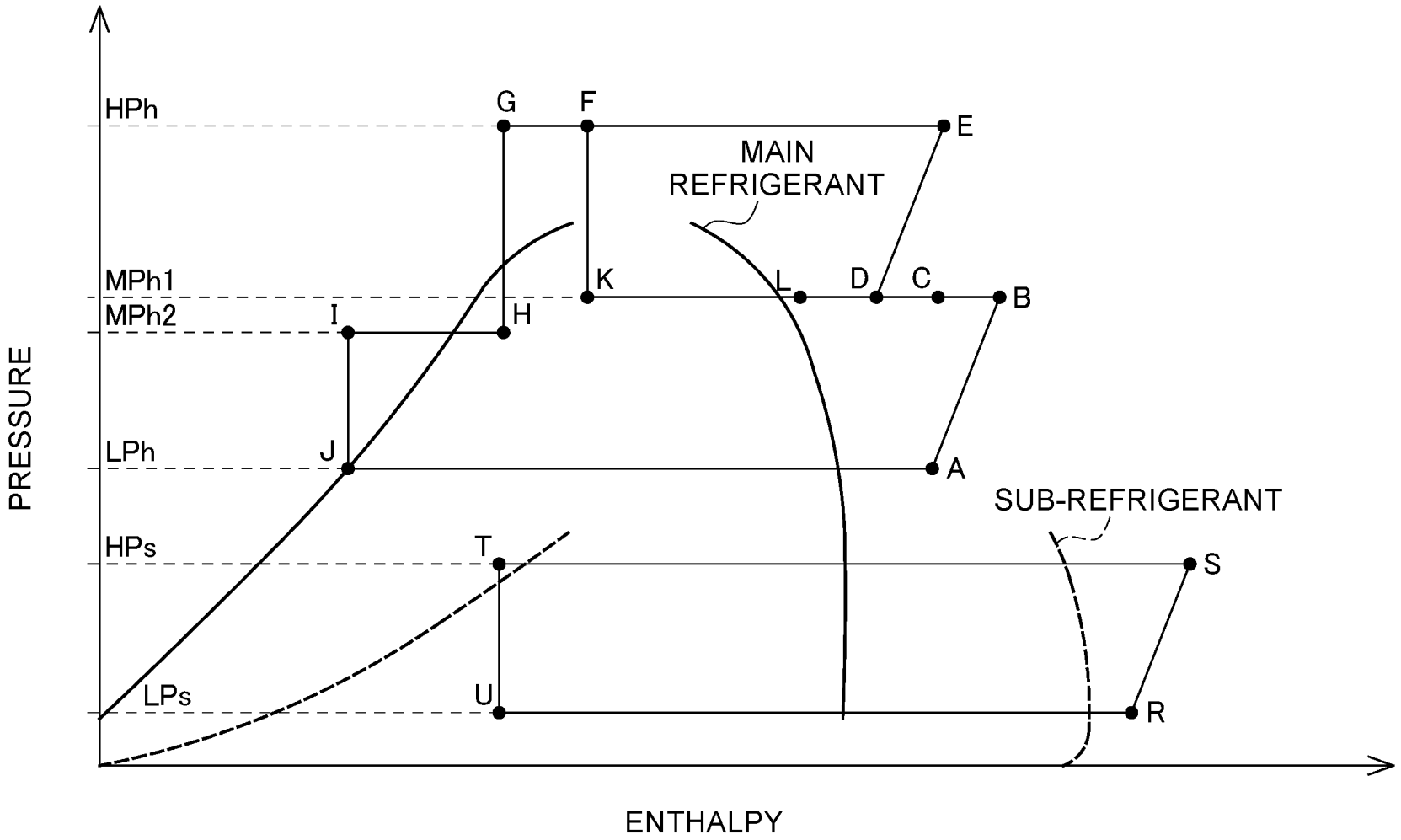
FIG. 3 is a pressure-enthalpy diagram illustrating the refrigeration cycle at the time of the cooling operation.
Figure 4:
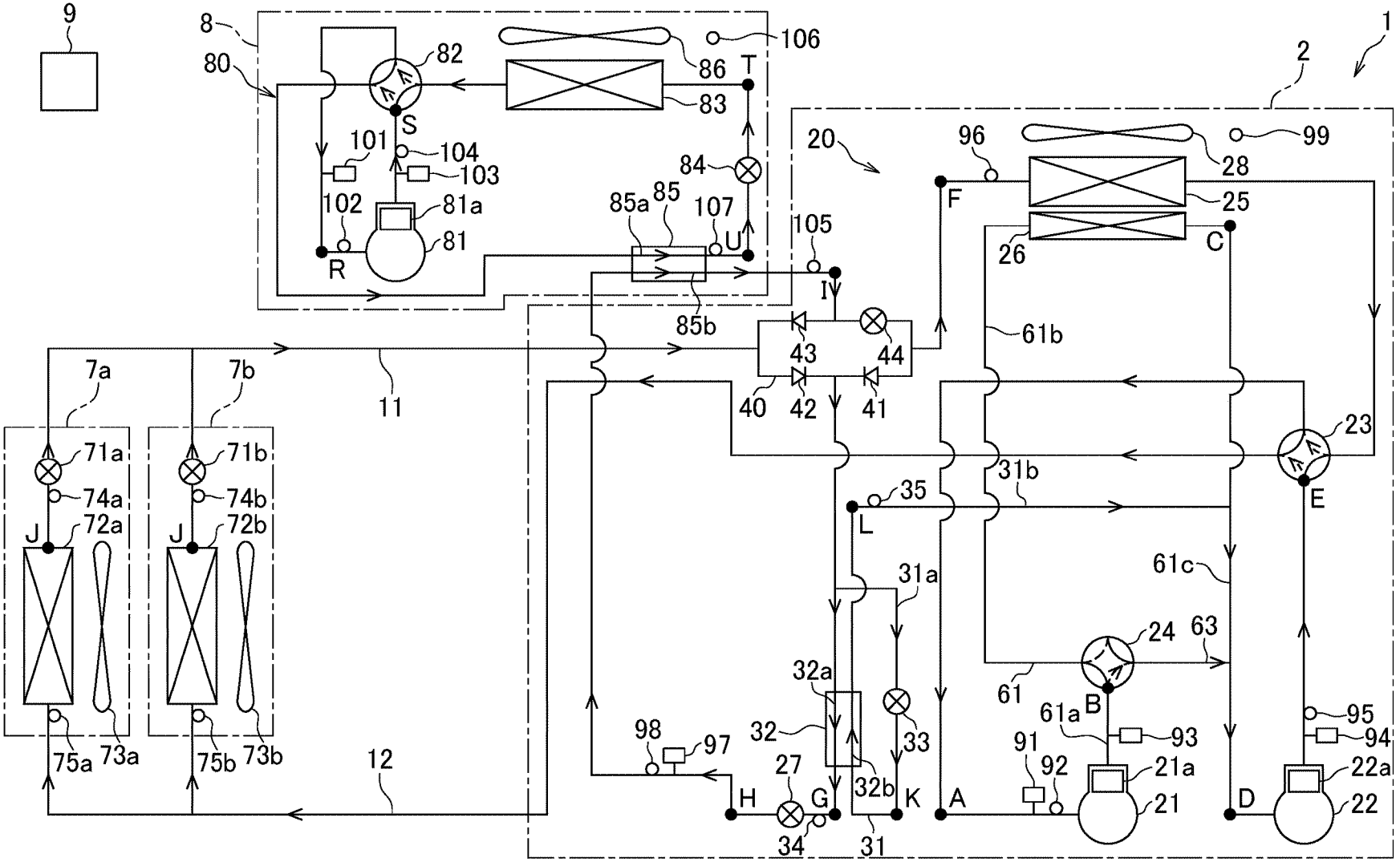
FIG. 4 illustrates flow of a refrigerant in the refrigeration cycle device in a heating operation.
Figure 5:
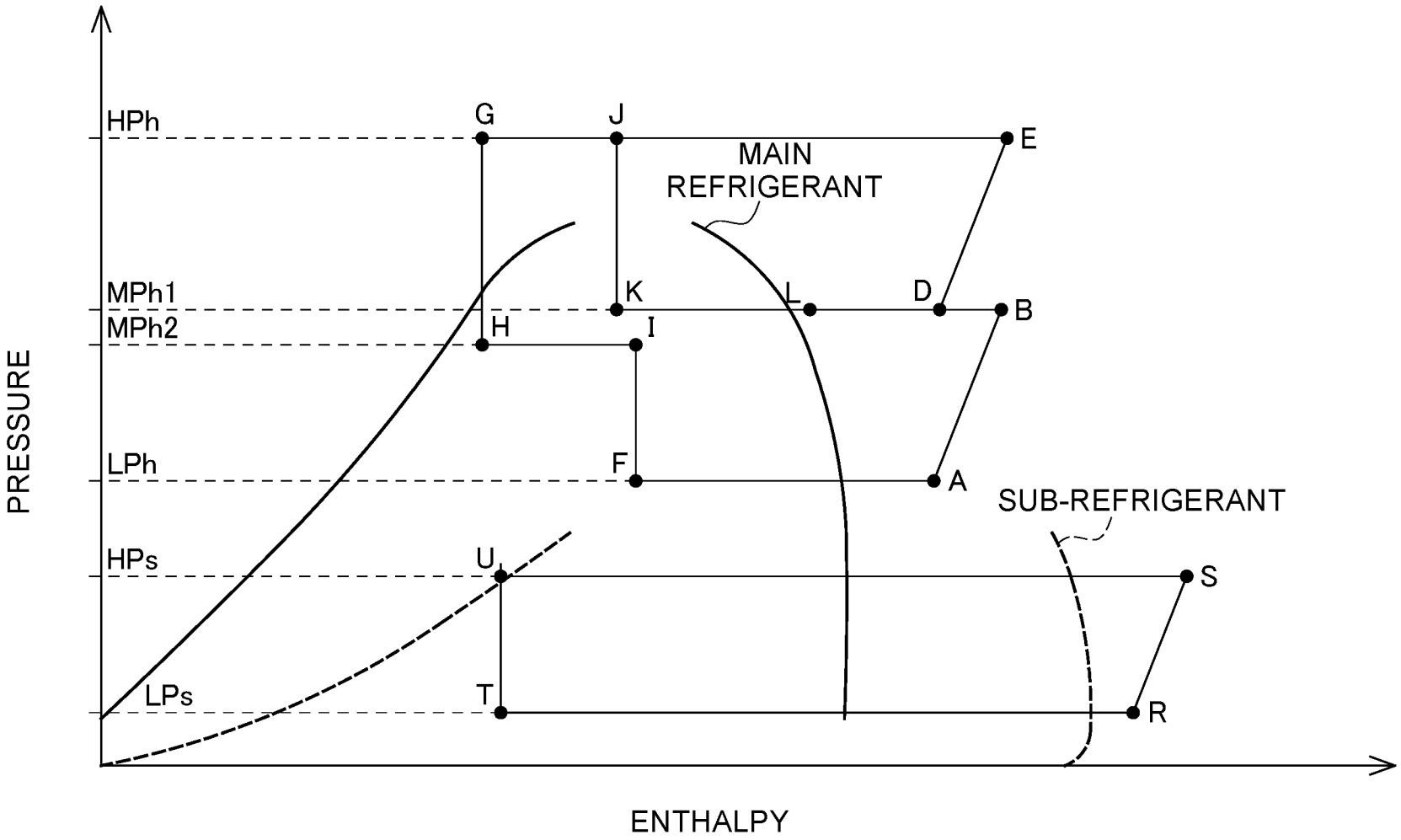
FIG. 5 is a pressure-enthalpy diagram illustrating the refrigeration cycle at the time of the heating operation.
Figure 6:
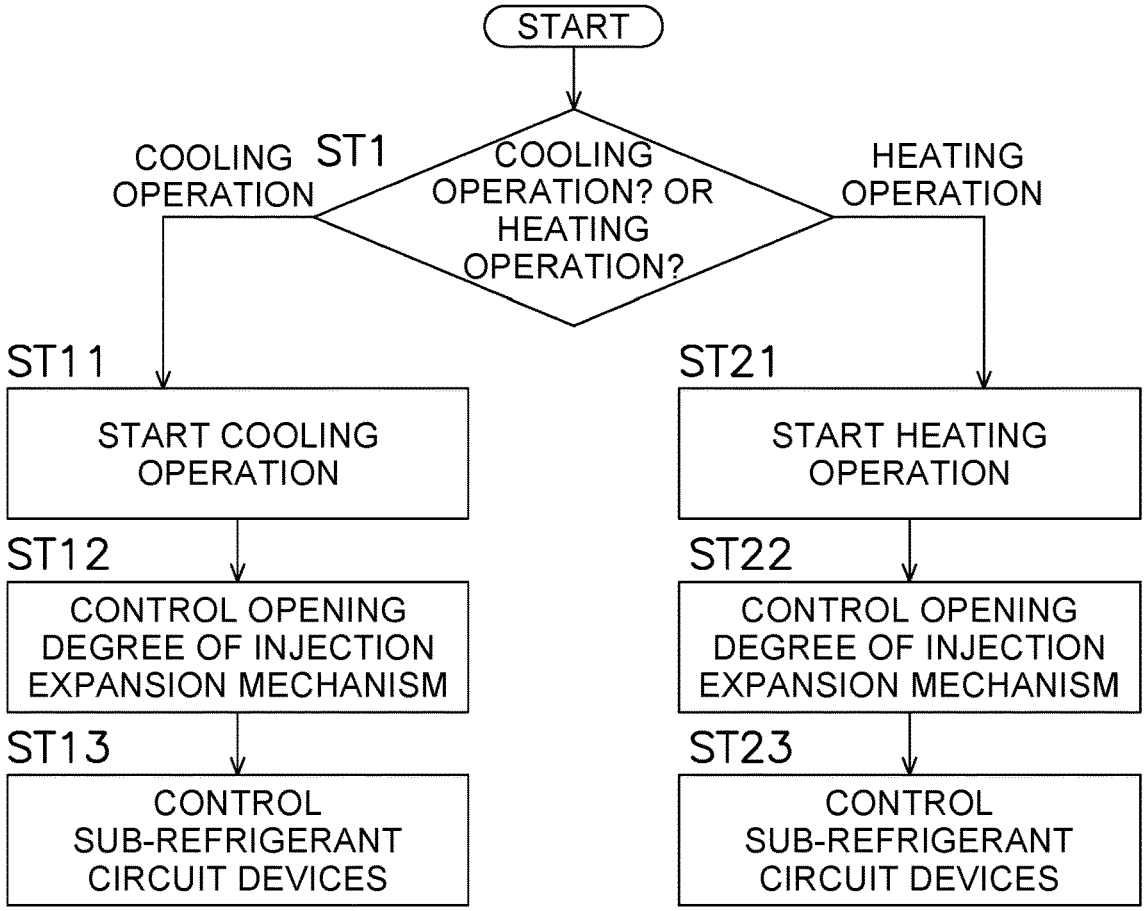
FIG. 6 is a flow chart of interlocking control between a main refrigerant circuit and a sub-refrigerant circuit.
Figure 7:
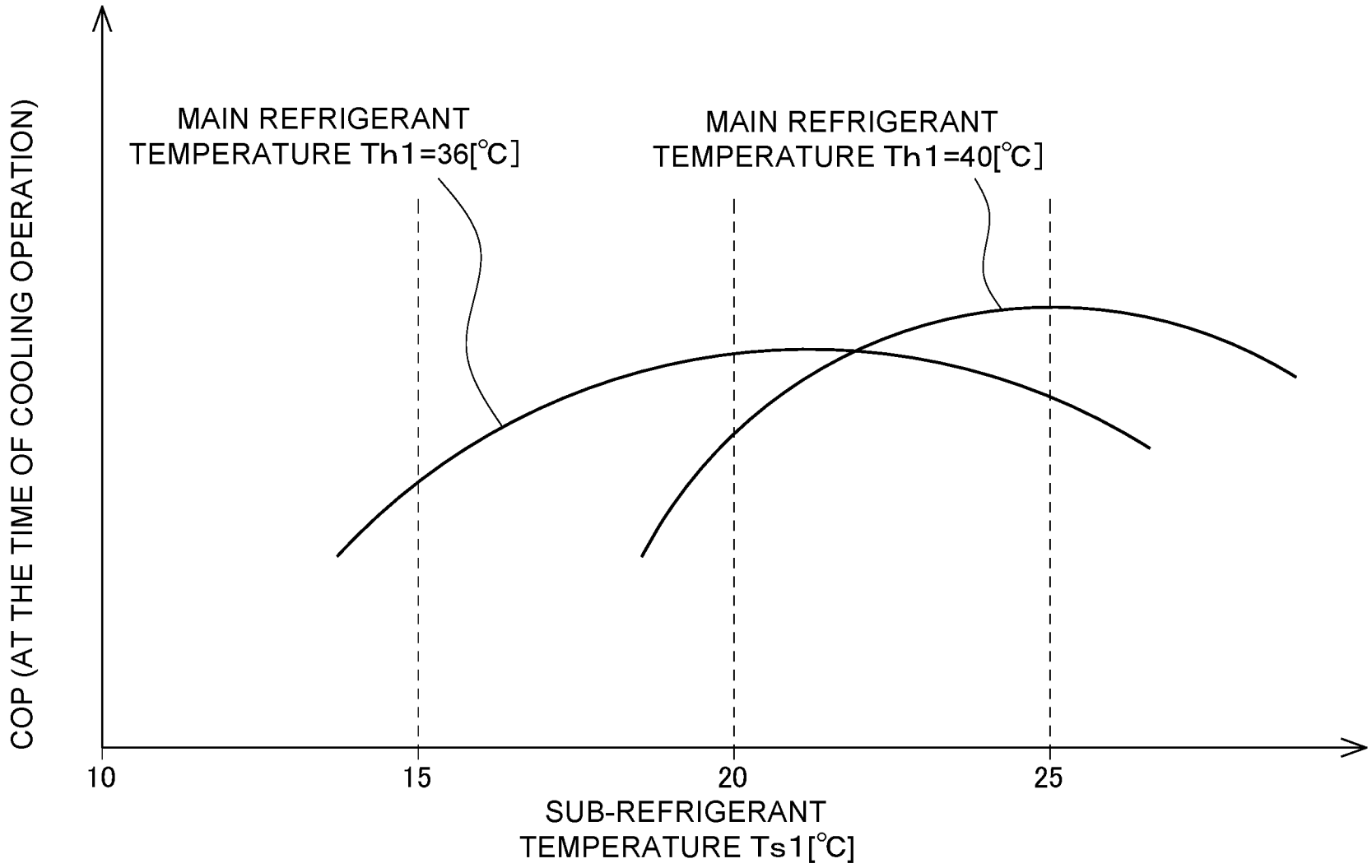
FIG. 7 is a diagram showing changes in a coefficient of performance of the main refrigerant circuit based on the temperature of a main refrigerant at an inlet of a main expansion mechanism and the temperature of a sub-refrigerant at an outlet of a sub-usage-side heat exchanger at the time of the cooling operation.

Next, the operation of the refrigeration cycle device 1 is described by using FIGS. 2 to 7. Here, FIG. 2 illustrates flow of a refrigerant in the refrigeration cycle device 1 in a cooling operation. FIG. 3 is a pressure-enthalpy diagram illustrating the refrigeration cycle at the time of the cooling operation. FIG. 4 illustrates flow of a refrigerant in the refrigeration cycle device 1 in a heating operation. FIG. 5 is a pressure-enthalpy diagram illustrating the refrigeration cycle at the time of the heating operation. FIG. 6 is a flow chart of interlocking control between the main refrigerant circuit 20 and the sub-refrigerant circuit 80. FIG. 7 is a diagram showing changes in a coefficient of performance of the main refrigerant circuit 20 based on a temperature Th1 of a main refrigerant at an inlet of the main expansion mechanism 27 and a temperature Ts1 of a sub-refrigerant at an outlet of the sub-usage-side heat exchanger 85 at the time of the cooling operation.

The refrigeration cycle device 1 is capable of performing, in air-conditioning the interior of a room, a cooling operation that cools indoor air by causing the main usage-side heat exchangers 72*a* and 72*b* to function as evaporators of the main refrigerant and a heating operation that heats the indoor air by causing the main usage-side heat exchangers 72*a* and 72*b* to function as radiators of the main refrigerant. Here, at the time of the cooling operation, a sub-refrigerant-circuit cooling operation that cools the main refrigerant by using the sub-refrigerant circuit 80 is performed, and, at the time of the heating operation, a sub-refrigerant-circuit heating operation that heats the main refrigerant by using the sub-refrigerant circuit 80 is performed. Note that operations for the cooling operation when the sub-refrigerant-circuit cooling operation is performed and for the heating operation when the sub-refrigerant-circuit heating operation is performed are performed by the control unit 9.

<Cooling Operation when Sub-Refrigerant-Circuit Cooling Operation is Performed>

At the time of the cooling operation, the first main flow-path switching mechanism 23 switches to the main cooling operation state shown by a solid line in FIG. 2, and the second main flow-path switching mechanism 24 switches to the intermediate heat-exchange heat dissipation state shown by a solid line in FIG. 2. In addition, since the first main flow-path switching mechanism 23 is switched to the main cooling operation state, the first downstream-side main expansion mechanism 44 is closed. At the time of the cooling operation, since the sub-refrigerant-circuit cooling operation is performed, the sub-flow-path switching mechanism 82 switches to the sub-cooling operation state shown by a solid line in FIG. 2.

In the state of the main refrigerant circuit 20, the main refrigerant at a low pressure (LPh) (refer to point A in FIGS. 2 and 3) in the refrigeration cycle is sucked by the first main compressor 21, and, at the first main compressor 21, the main refrigerant is compressed to an intermediate pressure (MPh1) in the refrigeration cycle and is discharged (refer to point B in FIGS. 2 and 3).

The main refrigerant at the intermediate pressure discharged from the first main compressor 21 is sent to the intermediate heat exchanger 26 via the second main flow-path switching mechanism 24, and, at the intermediate heat exchanger 26, exchanges heat with outdoor air that is sent by the heat-source-side fan 28 and is cooled (refer to point C in FIGS. 2 and 3).

The main refrigerant at the intermediate pressure that has been cooled at the intermediate heat exchanger 26 is further cooled by merging with a main refrigerant at an intermediate pressure that is sent to the suction side of the second main compressor 22 from the intermediate injection pipe 31 (the second intermediate injection pipe 31*b*) (refer to point D in FIGS. 2 and 3).

The main refrigerant at the intermediate pressure provided by injection of the main refrigerant from the intermediate injection pipe 31 is sucked by the second main compressor 22, and, at the second main compressor 22, is compressed to a high pressure (HPh) in the refrigeration cycle and is discharged (refer to point E in FIGS. 2 and 3). Here, the main refrigerant at the high pressure discharged from the second main compressor 22 has a pressure that exceeds the critical pressure of the main refrigerant.

The main refrigerant at the high pressure discharged from the second main compressor 22 is sent to the main heat-source-side heat exchanger 25, and, at the main heat-source-side heat exchanger 25, exchanges heat with outdoor air that is sent by the heat-source-side fan 28 and is cooled (refer to point F in FIGS. 2 and 3).

After the main refrigerant at the high pressure that has been cooled at the main heat-source-side heat exchanger 25 has passed through the inlet check mechanism 41 of the bridge circuit 40, a part of the main refrigerant branches off into the intermediate injection pipe 31 in accordance with the opening degree of the intermediate injection expansion mechanism 33 and the remaining part is sent to the economizer heat exchanger 32 (the first economizer flow path 32*a*). The main refrigerant at the high pressure that has branched off into the intermediate injection pipe 31 is decompressed to the intermediate pressure (MPh1) and changes a gas-liquid two-phase state (refer to point K in FIGS. 2 and 3) in the intermediate injection expansion mechanism 33, and is sent to the economizer heat exchanger 32 (the second economizer flow path 32*b*). At the economizer heat exchanger 32, the main refrigerant at the high pressure that flows in the first economizer flow path 32*a* exchanges heat with the main refrigerant at the intermediate pressure and in the gas-liquid two-phase state that flows in the second economizer flow path 32*b*, and is cooled (refer to point G in FIGS. 2 and 3). In contrast, the main refrigerant at the intermediate pressure and in the gas-liquid two-phase state that flows in the second economizer flow path 32*b* exchanges heat with the main refrigerant at the high pressure that flows in the first economizer flow path 32*a* and is heated (refer to point L in FIGS. 2 and 3), and, as described above, merges with the main refrigerant at the intermediate pressure that has been cooled at the intermediate heat exchanger 26, and is sent to the suction side of the second main compressor 22.

The main refrigerant at the high pressure that has been cooled at the economizer heat exchanger 32 is sent to the upstream-side main expansion mechanism 27, and, at the upstream-side main expansion mechanism 27, is decompressed to an intermediate pressure (MPh2) in the refrigeration cycle, and changes a gas-liquid two-phase state (refer to point H in FIGS. 2 and 3).

The main refrigerant at the intermediate pressure that has been decompressed at the upstream-side main expansion mechanism 27 is sent to the sub-usage-side heat exchanger 85 (second sub-flow path 85*b*).

On the other hand, at the sub-refrigerant circuit 80, the sub-refrigerant (refer to point R in FIGS. 2 and 3) at a low pressure (LPs) in the refrigeration cycle is sucked by the sub-compressor 81, and, at the sub-compressor 81, the sub-refrigerant is compressed to a high pressure (HPs) in the refrigeration cycle and is discharged (refer to point S in FIGS. 2 and 3).

The sub-refrigerant at the high pressure discharged from the sub-compressor 81 is sent to the sub-heat-source-side heat exchanger 83 via the sub-flow-path switching mechanism 82, and, at the sub-heat-source-side heat exchanger 83, exchanges heat with outdoor air that is sent by the sub-side fan 86 and is cooled (refer to point T in FIGS. 2 and 3).

The sub-refrigerant at the high pressure that has been cooled at the sub-heat-source-side heat exchanger 83 is sent to the sub-expansion mechanism 84, and, at the sub-expansion mechanism 84, is decompressed to a low pressure and changes a gas-liquid two-phase state (refer to point U in FIGS. 2 and 3).

Then, at the sub-usage-side heat exchanger 85, a main refrigerant at the intermediate pressure that flows in the second sub-flow path 85*b* exchanges heat with the sub-refrigerant at the low pressure and in the gas-liquid two-phase state that flows in the first sub-flow path 85*a*, and is cooled (refer to point I in FIGS. 2 and 3). In contrast, the sub-refrigerant at the low pressure and in the gas-liquid two-phase state that flows in the first sub-flow path 85*a* exchanges heat with the main refrigerant at the intermediate pressure that flows in the second sub-flow path 85*b* and is heated (refer to point R in FIGS. 2 and 3), and is sucked in on the suction side of the sub-compressor 81 again via the sub-flow-path switching mechanism 82.

The main refrigerant at the intermediate pressure that has been cooled at the sub-usage-side heat exchanger 85 is sent to the main usage-side expansion mechanisms 71*a* and 71*b* via the outlet check mechanism 43 of the bridge circuit 40 and the first main refrigerant connection pipe 11, and, at the main usage-side expansion mechanisms 71*a* and 71*b*, is decompressed to the low pressure (LPh) and changes a gas-liquid two-phase state (refer to points J in FIGS. 2 and 3).

The main refrigerant at the low pressure that has been decompressed at the main usage-side expansion mechanisms 71*a* and 71*b* is sent to the corresponding main usage-side heat exchangers 72*a* and 72*b*, and, at the corresponding main usage-side heat exchangers 72*a* and 72*b*, exchanges heat with indoor air that is sent by the corresponding usage-side fans 73*a* and 73*b*, is heated, and evaporates (refer to the point A in FIGS. 2 and 3). In contrast, the indoor air exchanges heat with the main refrigerant at the low pressure and in the gas-liquid two-phase state that flows in the main usage-side heat exchangers 72*a* and 72*b* and is cooled, as a result of which the interior of a room is cooled.

The main refrigerant at the low pressure that has evaporated at the main usage-side heat exchangers 72*a* and 72*b* is sent to the suction side of the first main compressor 21 via the second main refrigerant connection pipe 12 and the first main flow-path switching mechanism 23, and is sucked by the first main compressor 21 again. In this way, the cooling operation when the sub-refrigerant-circuit cooling operation is performed is performed.

<Heating Operation when Sub-Refrigerant-Circuit Heating Operation is Performed>

At the time of the heating operation, the first main flow-path switching mechanism 23 switches to the main heating operation state shown by a broken line in FIG. 4, and the second main flow-path switching mechanism 24 switches to the intermediate heat-exchange bypass state shown by a broken line in FIG. 4. In addition, since the first main flow-path switching mechanism 23 is switched to the main heating operation state, the first downstream-side main expansion mechanism 44 is opened. At the time of the heating operation, since the sub-refrigerant-circuit heating operation is performed, the sub-flow-path switching mechanism 82 switches to the sub-heating operation state shown by a broken line in FIG. 4.

In the state of the main refrigerant circuit 20, the main refrigerant at the low pressure (LPh) (refer to point A in FIGS. 4 and 5) in the refrigeration cycle is sucked by the first main compressor 21, and, at the first main compressor 21, the main refrigerant is compressed to the intermediate pressure (MPh1) in the refrigeration cycle and is discharged (refer to point B in FIGS. 4 and 5).

The main refrigerant at the intermediate pressure that has been discharged from the first main compressor 21 is sent to the suction side of the second main compressor 22 via the second main flow-path switching mechanism 24 and the intermediate heat-exchange bypass pipe 63 without dissipating heat at the intermediate heat exchanger 26.

The main refrigerant at the intermediate pressure that has bypassed the intermediate heat exchanger 26 is cooled by merging with a main refrigerant at an intermediate pressure that is sent to the suction side of the second main compressor 22 from the intermediate injection pipe 31 (the second intermediate injection pipe 31*b*) (refer to point Din FIGS. 4 and 5).

The main refrigerant at the intermediate pressure provided by injection of the main refrigerant from the intermediate injection pipe 31 is sucked by the second main compressor 22, and, at the second main compressor 22, is compressed to the high pressure (HPh) in the refrigeration cycle and is discharged (refer to point E in FIGS. 4 and 5). Here, the main refrigerant at the high pressure discharged from the second main compressor 22 has a pressure that exceeds the critical pressure of the main refrigerant.

The main refrigerant at the high pressure that has been discharged from the second main compressor 22 is sent to the main usage-side heat exchangers 72*a* and 72*b* via the first main flow-path switching mechanism 23 and the second main refrigerant connection pipe 12, and, at the main usage-side heat exchangers 72*a* and 72*b*, exchanges heat with indoor air that is sent by the usage-side fans 73*a* and 73*b* and dissipates heat (refer to the point J in FIGS. 4 and 5). In contrast, the indoor air exchanges heat with the main refrigerant at the high pressure that flows in the main usage-side heat exchangers 72*a* and 72*b* and is heated, as a result of which the interior of a room is heated.

After the main refrigerant at the high pressure that has dissipated heat at the main usage-side heat exchangers 72*a* and 72*b* has passed through the main usage-side expansion mechanisms 71*a* and 71*b*, the first main refrigerant connection pipe 11, and the inlet check mechanism 42 of the bridge circuit 40, a part of the main refrigerant branches off into the intermediate injection pipe 31 in accordance with the opening degree of the intermediate injection expansion mechanism 33 and the remaining part is sent to the economizer heat exchanger 32 (the first economizer flow path 32*a*). The main refrigerant at the high pressure that has branched off into the intermediate injection pipe 31 is decompressed to the intermediate pressure (MPh1) and changes a gas-liquid two-phase state (refer to point K in FIGS. 4 and 5) in the intermediate injection expansion mechanism 33, and is sent to the economizer heat exchanger 32 (the second economizer flow path 32*b*). At the economizer heat exchanger 32, the main refrigerant at the high pressure that flows in the first economizer flow path 32*a* exchanges heat with the main refrigerant at the intermediate pressure and in the gas-liquid two-phase state that flows in the second economizer flow path 32*b*, and is cooled (refer to point G in FIGS. 4 and 5). In contrast, the main refrigerant at the intermediate pressure and in the gas-liquid two-phase state that flows in the second economizer flow path 32*b* exchanges heat with the main refrigerant at the high pressure that flows in the first economizer flow path 32*a* and is heated (refer to point L in FIGS. 4 and 5), and, as described above, merges with the main refrigerant at the intermediate pressure that has bypassed the intermediate heat exchanger 26, and is sent to the suction side of the second main compressor 22.

The main refrigerant at the high pressure that has been cooled at the economizer heat exchanger 32 is sent to the upstream-side main expansion mechanism 27, and, at the upstream-side main expansion mechanism 27, is decompressed to the intermediate pressure (MPh2) in the refrigeration cycle, and changes a gas-liquid two-phase state (refer to point H in FIGS. 4 and 5).

The main refrigerant at the intermediate pressure that has been decompressed at the upstream-side main expansion mechanism 27 is sent to the sub-usage-side heat exchanger 85 (second sub-flow path 85*b*).

On the other hand, at the sub-refrigerant circuit 80, the sub-refrigerant at the low pressure (LPs) in the refrigeration cycle (refer to point R in FIGS. 4 and 5) is sucked by the sub-compressor 81, and, at the sub-compressor 81, the sub-refrigerant is compressed to the high pressure (HPs) in the refrigeration cycle and is discharged (refer to point S in FIGS. 4 and 5).

The sub-refrigerant at the high pressure that has been discharged from the sub-compressor 81 is sent to the sub-heat-source-side heat exchanger 83 via the sub-flow-path switching mechanism 82.

Then, at the sub-usage-side heat exchanger 85, the main refrigerant at the intermediate pressure that flows in the second sub-flow path 85*b* exchanges heat with the sub-refrigerant at the high pressure that flows in the first sub-flow path 85*a*, and is heated (refer to point I in FIGS. 4 and 5). In contrast, the sub-refrigerant at the high pressure that flows in the first sub-flow path 85*a* exchanges heat with the main refrigerant at the intermediate pressure that flows in the second sub-flow path 85*b* and is cooled (refer to point U in FIGS. 4 and 5).

The sub-refrigerant at the high pressure that has been cooled at the sub-usage-side heat exchanger 85 is sent to the sub-expansion mechanism 84, and, at the sub-expansion mechanism 84, is decompressed to a low pressure and changes a gas-liquid two-phase state (refer to point T in FIGS. 4 and 5).

The sub-refrigerant at the low pressure that has been decompressed at the sub-expansion mechanism 84 is sent to the sub-heat-source-side heat exchanger 83, and, at the sub-heat-source-side heat exchanger 83, exchanges heat with outdoor air that is sent by the sub-side fan 86 and is heated (refer to point R in FIGS. 4 and 5), and is sucked in on the suction side of the sub-compressor 81 again via the sub-flow-path switching mechanism 82.

The main refrigerant at the intermediate pressure that has been heated at the sub-usage-side heat exchanger 85 is, at the first downstream-side main expansion mechanism 44 of the bridge circuit 40, decompressed to a low pressure (refer to point F in FIGS. 4 and 5), and is sent to the main heat-source-side heat exchanger 25 that functions as an evaporator of the main refrigerant.

The main refrigerant at the low pressure that has been sent to the main heat-source-side heat exchanger 25 evaporates by exchanging heat with outdoor air that is supplied by the heat-source-side fan 28 at the main heat-source-side heat exchanger 25. In addition, the main refrigerant at the low pressure that has evaporated at the main heat-source-side heat exchanger 25 is sent to the suction side of the first main compressor 21 via the first main flow-path switching mechanism 23, and is sucked by the first main compressor 21 again. In this way, the heating operation when the sub-refrigerant-circuit heating operation is performed is performed.

<Interlocking Control Between Main Refrigerant Circuit and Sub-Refrigerant Circuit>

Next, interlocking control between the main refrigerant circuit 20 and the sub-refrigerant circuit 80 at the time of the cooling operation when the sub-refrigerant-circuit cooling operation is performed and at the time of the heating operation when the sub-refrigerant-circuit heating operation is performed is described.

Here, when the sub-refrigerant circuit 80 is controlled independently of the main refrigerant circuit 20, in performing the cooling operation, the balance between the cooling heat amount of the main refrigerant at the economizer heat exchanger 32 (refer to the points F and G in FIG. 3) and the cooling heat amount of the main refrigerant at the sub-usage-side heat exchanger 85 (refer to points H and I in FIG. 3) may be lost. In addition, in performing the heating operation, the balance between the flow rate of the main refrigerant that flows in the injection pipe 31 and the heating heat amount of the main refrigerant at the sub-usage-side heat exchanger 85 (refer to the points H and I in FIG. 5) may be lost.

Therefore, here, as described below, the constituent devices of the main refrigerant circuit 20 and the sub-refrigerant circuit 80 are controlled so that the main refrigerant circuit 20 and the sub-refrigerant circuit 80 are interlocked. Therefore, the cooling heat amount of the main refrigerant at the economizer heat exchanger 32 and the cooling heat amount of the main refrigerant at the sub-usage-side heat exchanger 85 are suitably balanced when performing the cooling operation, and the flow rate of the main refrigerant that flows in the injection pipe 31 and the heating heat amount of the main refrigerant at the sub-usage-side heat exchanger 85 are suitably balanced when performing the heating operation.

—Interlocking Control at the Time of Cooling Operation when Sub-Refrigerant-Circuit Cooling Operation is Performed—

As shown in FIG. 6, when, in Step ST1, the control unit 9 selects the cooling operation, the cooling operation when the sub-refrigerant-circuit cooling operation is performed is started in Step S11. At this time, in the main refrigerant circuit 20, the injection expansion mechanism 33 is set at a predetermined opening degree, and, at the sub-refrigerant circuit 80, the sub-compressor 81 is set at a predetermined capacity and the sub-expansion mechanism 84 is set at a predetermined opening degree.

Next, in Step ST12, the control unit 9 controls the opening degree of the injection expansion mechanism 33 based on a superheating degree SHh1 of the main refrigerant that flows in the injection pipe 31 at an outlet of the economizer heat exchanger 32. Here, for example, the control unit 9 controls the opening degree of the injection expansion mechanism 33 so that the superheating degree SHh1 becomes a first main refrigerant target superheating degree SHh1*t*. Note that the superheating degree SHh1 is obtained by converting the pressure (MPh1) of the main refrigerant that is detected by the pressure sensor 93 into saturation temperature, and subtracting the saturation temperature from the temperature of the main refrigerant that is detected by the temperature sensor 35. Here, the first main refrigerant target superheating degree SHh1 is set in accordance with an operating condition of the main refrigerant circuit 20 (any one of or a plurality of state quantities related to the main refrigerant circuit 20, such as an outside air temperature Ta, the high pressure HPh of the main refrigerant, the low pressure LPh of the main refrigerant, and a temperature Th2 of the main refrigerant at the main heat-source-side heat exchanger 25). Note that the outside air temperature Ta is detected by the temperature sensor 99 or the temperature sensor 106, the temperature Th1 is detected by the temperature sensor 96, the high pressure HPh is detected by the pressure sensor 94, and the low pressure LPh is detected by the pressure sensor 91.

Next, in Step ST13, the control unit 9 controls the constituent devices of the sub-refrigerant circuit 20 based on a coefficient of performance COP of the main refrigerant circuit 20 with the opening degree of the injection expansion mechanism 33 being controlled so that the superheating degree SHh1 becomes the first main refrigerant target superheating degree SHh1*t*.

The coefficient of performance COP of the main refrigerant circuit 20 at the time of the cooling operation is correlated with the temperature Th1 of the main refrigerant at the inlet of the main expansion mechanism 27 (the outlet of the economizer heat exchanger 32) and the temperature Ts1 of the sub-refrigerant at the outlet of the sub-usage-side heat exchanger 85 as shown in FIG. 7. This correlation indicates the relationship of balance between the cooling heat amount of the main refrigerant at the economizer heat exchanger 32 and the cooling heat amount of the main refrigerant at the sub-usage-side heat exchanger 85. For example, when the temperature Th1 of the main refrigerant is 40° C., the coefficient of performance COP of the main refrigerant circuit 20 is a maximum when the temperature Ts1 of the sub-refrigerant is 25° C.

Specifically, an evaporation capacity Qe of the usage-side heat exchangers 72*a* and 72*b* at the time of the cooling operation increases as the cooling heat amount of the main refrigerant at the sub-usage-side heat exchanger 85 is increased by the sub-refrigerant-circuit cooling operation. However, increasing the cooling heat amount of the main refrigerant by the sub-refrigerant-circuit cooling operation means that consumption power Ws of the sub-refrigerant circuit 80 (primarily the consumption power of the sub-compressor 81) is increased. Here, the coefficient of performance COP of the main refrigerant circuit 20 is given by a value obtained by dividing the evaporation capacity Qe by the total value of consumption power Wh of the main refrigerant circuit 20 (primarily the consumption power of the main compressors 21 and 22) and the consumption power Ws of the sub-refrigerant circuit 80, that is, Qe/(Wh+Ws). Therefore, when the cooling heat amount of the main refrigerant is increased by the sub-refrigerant-circuit cooling operation with respect to the cooling heat amount of the main refrigerant at the economizer heat exchanger 32, the coefficient of performance COP of the main refrigerant circuit 20 increases in a range in which the consumption power Ws of the sub-refrigerant circuit 80 is small, whereas the coefficient of performance COP of the main refrigerant circuit 20 tends to be reduced in a range in which the consumption power Ws of the sub-refrigerant circuit 80 is large. That is, FIG. 7 shows this tendency and indicates that the coefficient of performance COP of the main refrigerant circuit 20 changes in accordance with the balance between the cooling heat amount of the main refrigerant at the economizer heat exchanger 32 and the cooling heat amount of the main refrigerant at the sub-usage-side heat exchanger 85, and an optimal point thereof exists.

Therefore, here, the control unit 9 sets a first sub-refrigerant target temperature Ts1*t*, which is the target value of the temperature Ts1 of the sub-refrigerant at the outlet of the sub-usage-side heat exchanger 85, in accordance with the correlation with the correlation being in the form of a data table or a function. For example, the control unit 9 obtains the temperature of the sub-refrigerant at which the coefficient of performance COP of the main refrigerant circuit 20 becomes a maximum from the temperature Th1 of the main refrigerant, and sets this temperature value as the first sub-refrigerant target temperature Ts1*t*.

In addition, the control unit 9 controls the constituent devices of the sub-refrigerant circuit 20 so that the temperature Ts1 of the sub-refrigerant becomes the first sub-refrigerant target temperature Ts1*t*. Specifically, the control unit 9 controls the opening degree of the sub-expansion mechanism 84 and the operating capacity of the sub-compressor 81 so that the temperature Ts1 of the sub-refrigerant becomes the first sub-refrigerant target temperature Ts1*t*. Here, the control unit 9 controls the opening degree of the sub-expansion mechanism 84 based on the superheating degree SHs1 of the sub-refrigerant at the outlet of the sub-usage-side heat exchanger 85 on the side of the sub-refrigerant circuit 80. For example, the control unit 9 controls the opening degree of the sub-expansion mechanism 84 so that the superheating degree SHs1 becomes a target value SHs1*t*. Note that the superheating degree SHs1 is obtained by converting the pressure (LPs) of the sub-refrigerant that is detected by the pressure sensor 101 into saturation temperature, and subtracting the saturation temperature from the temperature Ts1 of the sub-refrigerant that is detected by the temperature sensor 102. In addition, the control unit 9, while controlling the opening degree of the sub-expansion mechanism 84 based on the superheating degree SHs1 of the sub-refrigerant, controls the operating capacity of the sub-compressor 81 (the operating frequency and the number of rotations) so that the temperature Ts1 of the sub-refrigerant becomes the first sub-refrigerant target temperature Ts1*t*.

In this way, at the time of the cooling operation when the sub-refrigerant-circuit cooling operation is performed, the control unit 9 controls the injection expansion mechanism 33 and the constituent devices of the sub-refrigerant circuit 80 (the sub-compressor 81 and the sub-expansion mechanism 84) based on the coefficient of performance COP of the main refrigerant circuit 20. Note that, when the sub-compressor 81 is a compressor whose operating capacity (the operating frequency and the number of rotations) is constant, the opening degree of the sub-expansion mechanism 84 may be controlled so that the temperature Ts1 of the sub-refrigerant becomes the first sub-refrigerant target temperature Ts1*t*.

—Interlocking Control at the Time of Heating Operation when Sub-Refrigerant-Circuit Heating Operation is Performed—

As shown in FIG. 6, when, in Step ST1, the control unit 9 selects the cooling operation, the heating operation when the sub-refrigerant-circuit heating operation is performed is started in Step S12. At this time, in the main refrigerant circuit 20, the injection expansion mechanism 33 is set at a predetermined opening degree, and, at the sub-refrigerant circuit 80, the sub-compressor 81 is set at a predetermined capacity and the sub-expansion mechanism 84 is set at a predetermined opening degree.

Next, in Step ST22, the control unit 9, as at the time of the cooling operation, controls the opening degree of the injection expansion mechanism 33 based on the superheating degree SHh1 of the main refrigerant that flows in the injection pipe 31 at the outlet of the economizer heat exchanger 32. However, here, considering that the heating operation is performed, the control unit 9 controls the opening degree of the injection expansion mechanism 33 so that the superheating degree SHh1 becomes a second main refrigerant target superheating degree SHh2*t* (a value that differs from the first main refrigerant target superheating degree SHh1*t* at the time of the cooling operation).

Next, in Step ST23, the control unit 9 controls the constituent devices of the sub-refrigerant circuit 20 based on the coefficient of performance COP of the main refrigerant circuit 20 with the opening degree of the injection expansion mechanism 33 being controlled so that the superheating degree SHh1 becomes the second main refrigerant target superheating degree SHh2*t*.

Here, although not shown, as at the time of the cooling operation (refer to FIG. 7), the coefficient of performance COP of the main refrigerant circuit 20 at the time of the heating operation is correlated with the temperature Th1 of the main refrigerant at the inlet of the main expansion mechanism 27 (the outlet of the economizer heat exchanger 32) and a temperature Ts2 of the sub-refrigerant at the outlet of the sub-usage-side heat exchanger 85. Here, since the temperature Th1 of the main refrigerant at the inlet of the main expansion mechanism 27 (the outlet of the economizer heat exchanger 32) is equivalent to the flow rate of the main refrigerant that flows in the injection pipe 31, the correlation can be said to indicate the relationship of balance between the flow rate of the main refrigerant that flows in the injection pipe 31 and the heating heat amount of the main refrigerant at the sub-usage-side heat exchanger 85.

Specifically, a radiation capacity Qr of the usage-side heat exchangers 72*a* and 72*b* at the time of the heating operation increases as the heating heat amount of the main refrigerant at the sub-usage-side heat exchanger 85 is increased by the sub-refrigerant-circuit heating operation. However, increasing the heating heat amount of the main refrigerant by the sub-refrigerant-circuit heating operation means that consumption power Ws of the sub-refrigerant circuit 80 (primarily the consumption power of the sub-compressor 81) is increased. Here, the coefficient of performance COP of the main refrigerant circuit 20 is given by a value obtained by dividing the radiation capacity Qr by the total value of consumption power Wh of the main refrigerant circuit 20 (primarily the consumption power of the main compressors 21 and 22) and the consumption power Ws of the sub-refrigerant circuit 80, that is, Qr/(Wh+Ws). Therefore, when the heating heat amount of the main refrigerant is increased by the sub-refrigerant-circuit heating operation with respect to the flow rate of the main refrigerant that flows in the injection pipe 31, the coefficient of performance COP of the main refrigerant circuit 20 increases in the range in which the consumption power Ws of the sub-refrigerant circuit 80 is small, whereas the coefficient of performance COP of the main refrigerant circuit 20 tends to be reduced in the range in which the consumption power Ws of the sub-refrigerant circuit 80 is large. That is, this means that the coefficient of performance COP of the main refrigerant circuit 20 changes in accordance with the balance between the flow rate of the main refrigerant that flows in the injection pipe 31 and the heating heat amount of the main refrigerant at the sub-usage-side heat exchanger 85, and an optimal point thereof exists.

Therefore, here, the control unit 9 sets a second sub-refrigerant target temperature Ts2*t*, which is the target value of the temperature Ts2 of the sub-refrigerant at the outlet of the sub-usage-side heat exchanger 85, in accordance with the correlation with the correlation being in the form of a data table or a function. For example, the control unit 9 obtains the temperature of the sub-refrigerant at which the coefficient of performance COP of the main refrigerant circuit 20 becomes a maximum from the temperature Th1 of the main refrigerant, and sets this temperature value as the second sub-refrigerant target temperature Ts2*t*.

In addition, the control unit 9 controls the constituent devices of the sub-refrigerant circuit 20 so that the temperature Ts2 of the sub-refrigerant becomes the second sub-refrigerant target temperature Ts2*t*. Specifically, the control unit 9 controls the opening degree of the sub-expansion mechanism 84 and the operating capacity of the sub-compressor 81 so that the temperature Ts2 of the sub-refrigerant becomes the second sub-refrigerant target temperature Ts2*t*. Here, the control unit 9 controls the opening degree of the sub-expansion mechanism 84 based on a supercooling degree SCs1 of the sub-refrigerant at the outlet of the sub-usage-side heat exchanger 85 on the side of the sub-refrigerant circuit 80. For example, the control unit 9 controls the opening degree of the sub-expansion mechanism 84 so that the supercooling degree SCs1 becomes a target value SCs1*t*. Note that the supercooling degree SCs1 is obtained by converting the pressure (HPs) of the sub-refrigerant that is detected by the pressure sensor 103 into saturation temperature, and subtracting the temperature Ts2 of the sub-refrigerant that is detected by the temperature sensor 107 from the saturation temperature. In addition, the control unit 9, while controlling the opening degree of the sub-expansion mechanism 84 based on the supercooling degree SCs1 of the sub-refrigerant, controls the operating capacity of the sub-compressor 81 (the operating frequency and the number of rotations) so that the temperature Ts2 of the sub-refrigerant becomes the second sub-refrigerant target temperature Ts2*t*.

In this way, at the time of the heating operation when the sub-refrigerant-circuit heating operation is performed, the control unit 9 controls the injection expansion mechanism 33 and the constituent devices of the sub-refrigerant circuit 80 (the sub-compressor 81 and the sub-expansion mechanism 84) based on the coefficient of performance COP of the main refrigerant circuit 20. Note that, when the sub-compressor 81 is a compressor whose operating capacity (the operating frequency and the number of rotations) is constant, the opening degree of the sub-expansion mechanism 84 may be controlled so that the temperature Ts2 of the sub-refrigerant becomes the second sub-refrigerant target temperature Ts2*t*.

(3) Features

Next, the features of the refrigeration cycle device 1 are described.

<A>

Here, as described above, not only are the injection pipe 31 and the economizer heat exchanger 32 that are the same as those known in the art provided at the main refrigerant circuit 20 in which the main refrigerant circulates, but also the sub-refrigerant circuit 80 that differs from the main refrigerant circuit 20 and in which the sub-refrigerant circulates is provided.

In addition, the sub-usage-side heat exchanger 85 that is provided at the sub-refrigerant circuit 80 is provided at the main refrigerant circuit 20 so that, when performing an operation (cooling operation) by switching the first main flow-path switching mechanism 23 to a cooling operation state in which a main refrigerant circulates so that the main usage-side heat exchangers 72*a* and 72*b* function as evaporators of the main refrigerant, the sub-usage-side heat exchanger 85 functions as an evaporator of a sub-refrigerant that cools the main refrigerant cooled at the economizer heat exchanger 32. Therefore, here, the enthalpy of the main refrigerant that is sent to the main usage-side heat exchangers 72*a* and 72*b* is further reduced (refer to the points H and I in FIG. 3), and the heat exchange capacity that is obtained by evaporation of the main refrigerant at the main usage-side heat exchangers 72*a* and 72*b* (evaporation capacity of the usage-side heat exchangers 72*a* and 72*b*) can be increased (refer to the points J and A in FIG. 3).

In addition, the sub-usage-side heat exchanger 85 that is provided at the sub-refrigerant circuit 80 is provided at the main refrigerant circuit 20 so that, when performing an operation (heating operation) by switching the first main flow-path switching mechanism 23 to a heating operation state in which a main refrigerant circulates so that the main usage-side heat exchangers 72*a* and 72*b* function as radiators of a refrigerant, the sub-usage-side heat exchanger 85 functions as a radiator of a sub-refrigerant that heats the main refrigerant cooled at the economizer heat exchanger 32. Therefore, here, the enthalpy of the main refrigerant that is sent to the main heat-source-side heat exchanger 25 is increased (refer to the points H and I in FIG. 5), and the heat-exchange amount required to evaporate the main refrigerant at the main heat-source-side heat exchanger 25 can be decreased (refer to the points F and A in FIG. 5). Therefore, since the heat exchange rate at the main heat-source-side heat exchanger 25 is increased and the low pressure (LPh) of the main refrigerant is increased, it is possible to reduce the consumption power of the main compressors 21 and 22. In addition, when the low pressure of the main refrigerant is increased at the time of the heating operation, the formation of frost on the main heat-source-side heat exchanger 25 can be suppressed, as a result of which it is possible to reduce the frequency with which a defrosting operation is performed.

In this way, here, the refrigeration cycle device 1 in which the injection pipe 31 and the economizer heat exchanger 32 are provided at the refrigerant circuit 20 is capable of increasing the evaporation capacity of the usage-side heat exchangers 72*a* and 72*b* when operating to cause the usage-side heat exchangers 72*a* and 72*b* to function as evaporators of a refrigerant. In addition, it is possible to decrease the heat-exchange amount required to evaporate a refrigerant at the heat-source-side heat exchanger 25 when an operation that causes the usage-side heat exchangers 72*a* and 72*b* to function as radiators of a refrigerant is performed.

In particular, here, since, as the main refrigerant, carbon dioxide having a coefficient of performance that is lower than that of, for example, a HFC refrigerant is used, in the cooling operation, the radiation capacity of the refrigerant in the main heat-source-side heat exchanger 25 is easily reduced. Therefore, the tendency that the evaporation capacity of the main usage-side heat exchangers 72*a* and 72*b* becomes difficult to increase becomes noticeable. In addition, even in the heating operation, the tendency that the heat-exchange amount required to evaporate the refrigerant at the main heat-source-side heat exchanger 25 is increased becomes noticeable. However, here, as described above, it is possible to, by using the sub-refrigerant circuit 80, increase the evaporation capacity of the main usage-side heat exchangers 72*a* and 72*b* at the time of the cooling operation, and decrease the heat-exchange amount required to evaporate the refrigerant at the main heat-source-side heat exchanger 25 at the time of the heating operation. Therefore, it is possible to obtain a desired capacity even though carbon dioxide is used as the main refrigerant.

<B>

In addition, here, it is possible to send the main refrigerant that flows in the injection pipe 31 to a midway portion (location between the low-stage-side compression element 21*a* and the high-stage-side compression element 22*a*) of a compression stroke of the main compressors 21 and 22, which are a multi-stage compressor. Therefore, the main compressors 21 and 22 are capable of lowering the temperature of the main refrigerant that has been compressed to the intermediate pressure (MPh1) in the refrigeration cycle.

Further, here, as described above, when the first main flow-path switching mechanism 23 is in the main cooling operation state (at the time of the cooling operation), the intermediate heat exchanger 26 is capable of cooling the main refrigerant at the intermediate pressure that flows between the first main compressor 21 (the low-stage-side compression element 21*a*) and the second main compressor 22 (the high-stage-side compression element 22*a*) (refer to the point C in FIG. 3). Therefore, it is possible to avoid rise in the temperature of the main refrigerant at the high pressure that is discharged from the second main compressor 22 (refer to the point E in FIG. 3). Moreover, here, as described above, when the first main flow-path switching mechanism 23 is in the main heating operation state (at the time of the heating operation), the intermediate heat exchanger 26 is capable of evaporating the main refrigerant that has been heated at the sub-usage-side heat exchanger 85.

<C>

In addition, here, as described above, when the cooling operation is performed and when the heating operation is performed, it is possible to cause a main refrigerant that has not yet been decompressed at the main expansion mechanism 27 to flow in the economizer heat exchanger 32. Therefore, it is possible to increase the cooling capacity of the main refrigerant at the economizer heat exchanger 32.

<D>

When the sub-refrigerant circuit 80 is controlled independently of the main refrigerant circuit 20, in performing the cooling operation, the balance between the cooling heat amount of the main refrigerant at the economizer heat exchanger 32 (refer to the points F and Gin FIG. 3) and the cooling heat amount of the main refrigerant at the sub-usage-side heat exchanger 85 (refer to points H and I in FIG. 3) may be lost. In addition, in performing the heating operation, the balance between the flow rate of the main refrigerant that flows in the injection pipe 31 and the heating heat amount of the main refrigerant at the sub-usage-side heat exchanger 85 (refer to the points H and I in FIG. 5) may be lost.

However, here, as described above, the control unit 9 controls the constituent devices of the main refrigerant circuit 20 and the sub-refrigerant circuit 80 so that the main refrigerant circuit 20 and the sub-refrigerant circuit 80 are interlocked. Therefore, the cooling heat amount of the main refrigerant at the economizer heat exchanger 32 and the cooling heat amount of the main refrigerant at the sub-usage-side heat exchanger 85 can be suitably balanced when performing the cooling operation, and the flow rate of the main refrigerant that flows in the injection pipe 31 and the heating heat amount of the main refrigerant at the sub-usage-side heat exchanger 85 can be suitably balanced when performing the heating operation.

<E>

In addition, here, as described above, in performing control to cause the main refrigerant circuit 20 and the sub-refrigerant circuit 80 to be interlocked, the injection expansion mechanism 33 and the constituent devices of the sub-refrigerant circuit 80 are controlled based on the coefficient of performance COP of the main refrigerant circuit 20.

Therefore, here, in performing the cooling operation, the cooling heat amount of the main refrigerant at the economizer heat exchanger 32 and the cooling heat amount of the main refrigerant at the sub-usage-side heat exchanger 85 can be balanced based on the coefficient of performance COP of the main refrigerant circuit 20; and, in performing the heating operation, the flow rate of the main refrigerant that flows in the injection pipe 31 and the heating heat amount of the main refrigerant at the sub-usage-side heat exchanger 85 can be balanced based on the coefficient of performance COP of the main refrigerant circuit 20.

<F>

In addition, here, as described above, when performing the cooling operation, in controlling the injection expansion mechanism 33 and the constituent devices of the sub-refrigerant circuit 80 based on the coefficient of performance COP of the main refrigerant circuit 20, the injection expansion mechanism 33 is controlled based on the superheating degree SHh1 of the main refrigerant that flows in the injection pipe 31 at the outlet of the economizer heat exchanger 32.

In addition, here, as described above, when performing the cooling operation, in controlling the constituent devices of the sub-refrigerant circuit 80 based on the coefficient of performance COP of the main refrigerant circuit 20, the sub-refrigerant circuit 80 is controlled so that the temperature Ts1 of the sub-refrigerant at the outlet of the sub-usage-side heat exchanger 85 becomes the first sub-refrigerant target temperature Ts1*t* that is obtained based on the temperature Th1 of the main refrigerant at the inlet of the main expansion mechanism 27 and the coefficient of performance COP of the main refrigerant circuit 20.

Therefore, here, it is possible to balance the cooling heat amount of the main refrigerant at the sub-usage-side heat exchanger 85 while ensuring the cooling heat amount of the main refrigerant at the economizer heat exchanger 32.

<G>

In addition, here, as described above, when performing the heating operation, in controlling the injection expansion mechanism 33 and the constituent devices of the sub-refrigerant circuit 80 based on the coefficient of performance COP of the main refrigerant circuit 20, the injection expansion mechanism 33 is controlled based on the superheating degree SHh1 of the main refrigerant that flows in the injection pipe 31 at the outlet of the economizer heat exchanger 85.

In addition, here, as described above, when performing the heating operation, in controlling the constituent devices of the sub-refrigerant circuit 80 based on the coefficient of performance COP of the main refrigerant circuit 20, the sub-refrigerant circuit 80 is controlled so that the temperature Ts2 of the sub-refrigerant at the outlet of the sub-usage-side heat exchanger 85 becomes the second sub-refrigerant target temperature Ts2*t* that is obtained based on the temperature Th1 of the main refrigerant at the inlet of the main expansion mechanism 27 and the coefficient of performance COP of the main refrigerant circuit 20.

Therefore, here, it is possible to balance the heating heat amount of the main refrigerant at the sub-usage-side heat exchanger 85 while ensuring the flow rate of the main refrigerant that flows in the injection pipe 31.

<H>

Here, as described above, since carbon dioxide is used as the main refrigerant, and a refrigerant having a low GWP or a natural refrigerant having a coefficient of performance that is higher than that of carbon dioxide is used as the sub-refrigerant, it is possible to reduce environmental load, such as global warming.

(4) Modifications

<Modification 1>

In the embodiment above, although in Steps ST12 and ST22, the control unit 9 controls the opening degree of the injection expansion mechanism 33 based on the superheating degree SHh1 of the main refrigerant that flows in the injection pipe 31 at the outlet of the economizer heat exchanger 32, it is not limited thereto.

For example, in Steps ST12 and ST22, the control unit 9 may control the opening degree of the injection expansion mechanism 33 by setting target values Th1*t* and Th2*t* of the temperature Th1 of the main refrigerant at the inlet of the main expansion mechanism 27 (the outlet of the economizer heat exchanger 32) so that the temperature Th1 of the main refrigerant becomes the target values Th1*t* and Th2*t*. Here, the target value Th1*t* is a first main refrigerant target temperature serving as the target value of the temperature Th1 of the main refrigerant at the time of the cooling operation, and the target value Th2*t* is a second main refrigerant target temperature serving as the target value of the temperature Th1 of the main refrigerant at the time of the heating operation.

Even in this case, when performing the cooling operation and the heating operation, it is possible to control the injection expansion mechanism 33 and the constituent devices of the sub-refrigerant circuit 80 based on the coefficient of performance COP of the main refrigerant circuit 20.

<Modification 2>

Figure 8:
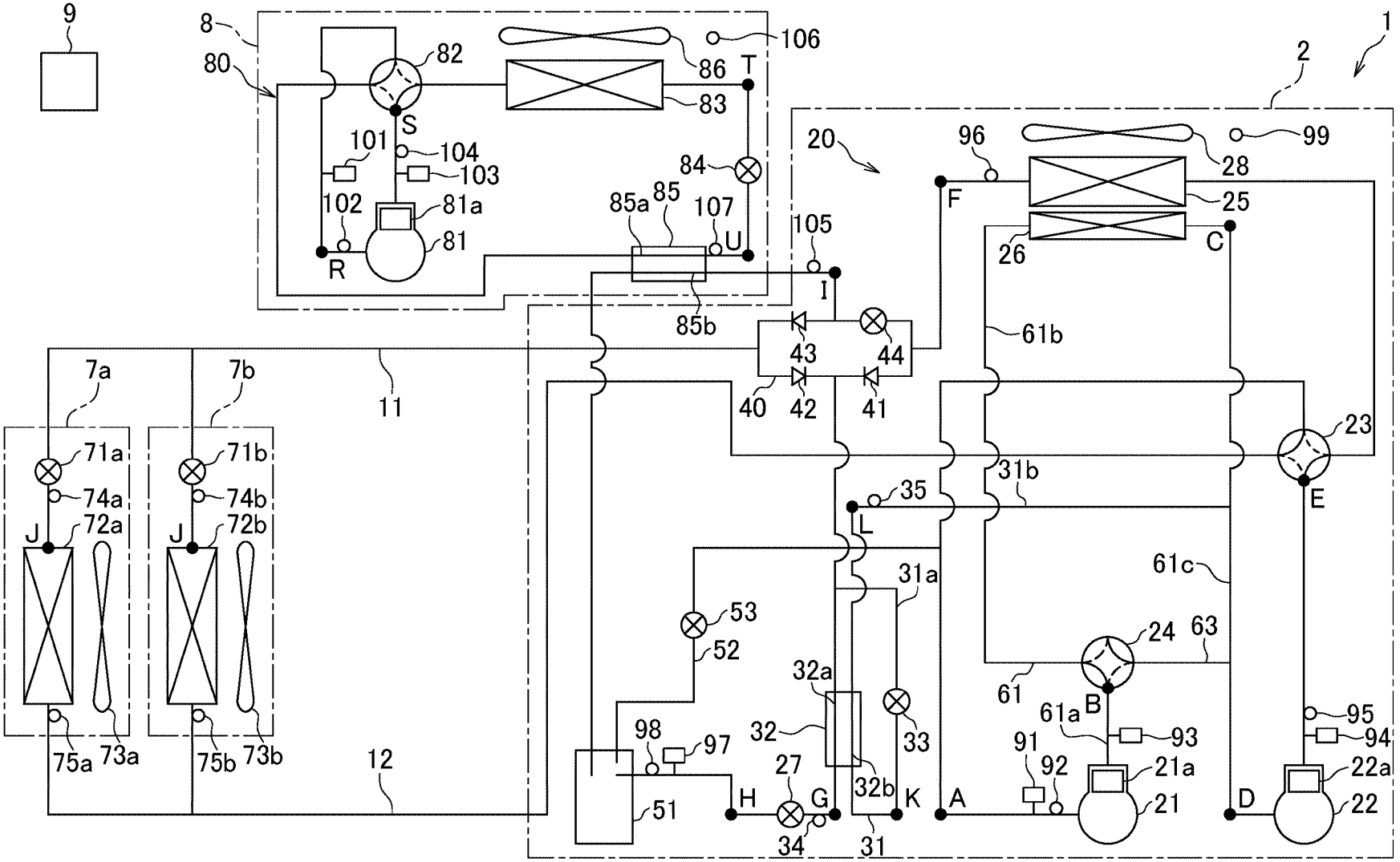
FIG. 8 is a schematic view of a configuration of a refrigeration cycle device of Modification 2.

Although, in the embodiment and Modification 1 above, the structure in which the main refrigerant that has been decompressed at the upstream-side main expansion mechanism 27 is directly sent to the sub-usage-side heat exchanger 85 (the second sub-flow path 85*b*) is used, it is not limited thereto. As shown in FIG. 8, a gas-liquid separator 51 may be provided between the upstream-side main expansion mechanism 27 and the sub-usage-side heat exchanger 85.

The gas-liquid separator 51 is a device that causes the main refrigerant to separate into gas and liquid, and, here, is a container at which the main refrigerant that has been decompressed at the upstream-side main expansion mechanism 27 separate into the gas and liquid. In addition, when the gas-liquid separator 51 is provided, it is desirable to further provide a degassing pipe 52 that extracts a main refrigerant in a gas state from the gas-liquid separator 51 and sends the main refrigerant to the suction side of the main compressors 21 and 22. Here, the degassing pipe 52 is a refrigerant pipe that sends the main refrigerant in the gas state extracted from the gas-liquid separator 51 to the suction side of the first main compressor 21. One end of the degassing pipe 52 is connected so as to communicate with an upper space of the gas-liquid separator 51, and the other end of the degassing pipe 52 is connected to the suction side of the first main compressor 21. The degassing pipe 52 has a degassing expansion mechanism 53. The degassing expansion mechanism 53 is a device that decompresses the main refrigerant, and, here, is an expansion mechanism that decompresses the main refrigerant that flows in the degassing pipe 52. The degassing expansion mechanism 53 is, for example, an electrically powered expansion valve.

Even in this case, as in the embodiment and Modification 1 above, it is possible to perform the cooling operation when the sub-refrigerant-circuit cooling operation is performed and the heating operation when the sub-refrigerant-circuit heating operation is performed.

Moreover, here, a main refrigerant in a liquid state after removal of the main refrigerant in the gas state at the gas-liquid separator 51 can be sent to the sub-usage-side heat exchanger 85. Therefore, at the time of the cooling operation, the sub-usage-side heat exchanger 85 is capable of further lowering the temperature of the main refrigerant. In addition, at the time of the heating operation, it is possible to further increase the low pressure (LPh) of the main refrigerant by reducing the flow rate of the main refrigerant that is sent to the sub-usage-side heat exchanger 85, the main heat-source-side heat exchanger 25, and the intermediate heat exchanger 26 and by reducing pressure loss.

<Modification 3>

Although, in the embodiment and Modifications 1 and 2 above, the multi-stage compressor is constituted by the plurality of main compressors 21 and 22, it is not limited thereto. The multi-stage compressor may be constituted by one main compressor including compression elements 21*a* and 21*b*.

<Modification 4>

Although, in the embodiment and Modifications 1 to 3 above, the structure in which the intermediate heat exchanger 26 that cools the main refrigerant is provided between the first main compressor 21 and the second main compressor 22 is used, it is not limited thereto. It is possible not to provide the intermediate heat exchanger 26.

<Modification 5>

Figure 9:
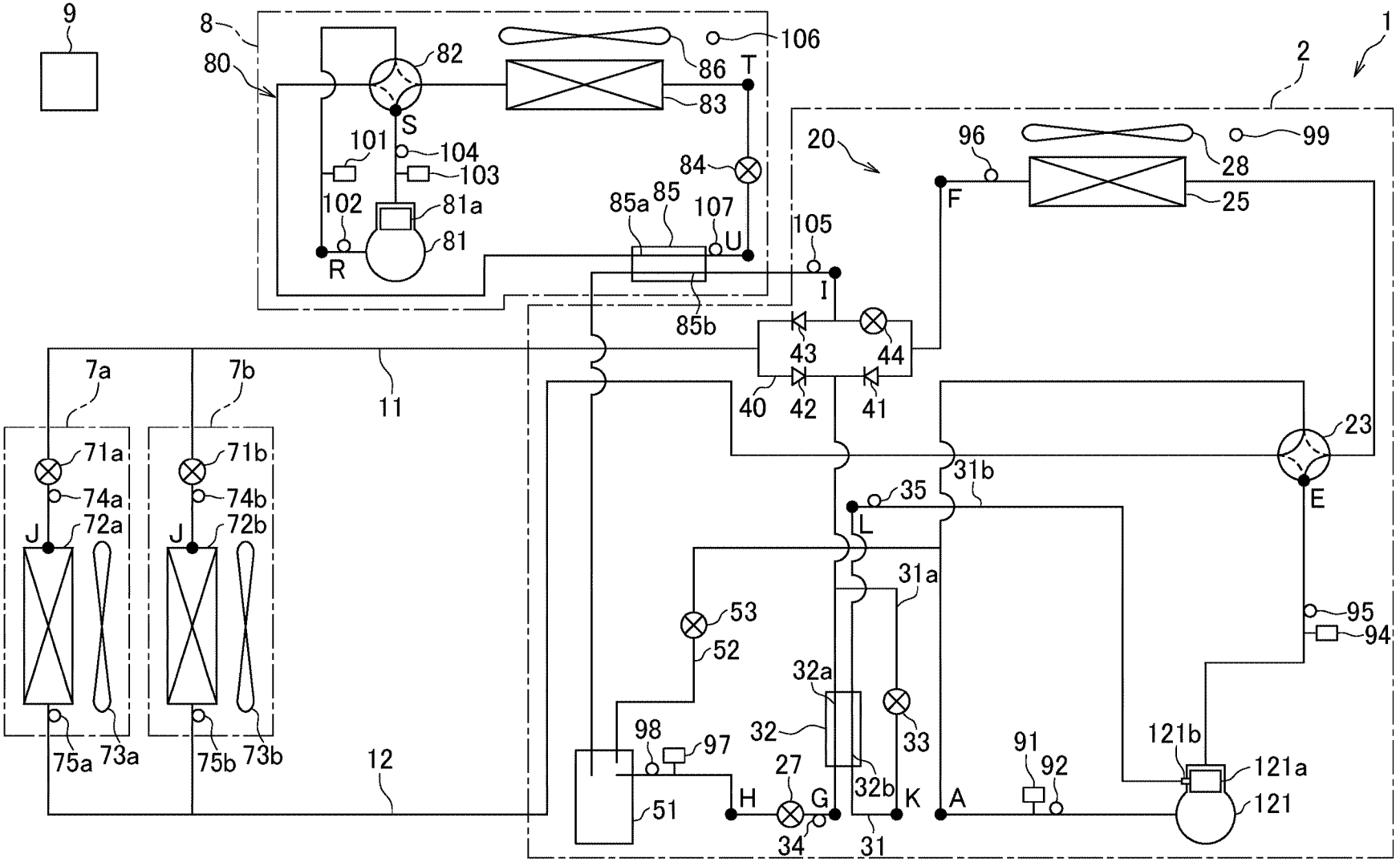
FIG. 9 is a schematic view of a configuration of a refrigeration cycle device of Modification 5.

When the structure that does not include the intermediate heat exchanger 26 is used as in Modification 4 above, it is possible not to use a multi-stage compressor as the compressor. For example, as shown in FIG. 9, as a main compressor 121, a single-stage compressor including a compression element 121*a* having an intermediate injection port 121*b* to which a main refrigerant is introduced from the outside in a compression stroke may be used, and the injection pipe 31 may be connected to the intermediate injection port 121*b*.

Even in this case, it is possible to send the main refrigerant that flows in the injection pipe 31 to a midway portion (the intermediate injection port 121*b*) of the compression stroke of the main compressor 121, which is a single-stage compressor. Therefore, as in the embodiment and Modifications 1 to 4 above, the main compressor 121 is capable of lowering the temperature of the main refrigerant that has been compressed to the intermediate pressure (MPh1) in the refrigeration cycle.

<Modification 6>

Although, in the embodiment and Modifications 1 to 5 above, the injection pipe 31 is connected so as to send the main refrigerant to the midway portion of the compression stroke of the main compressors 21 and 22 or the midway portion of the compression stroke of the main compressor 121 (location between the low-stage-side compression element 21*a* and the high-stage-side compression element 22*a* or the intermediate injection port 121*b*), it is not limited thereto. The injection pipe 31 may be connected so as to send the main refrigerant to the suction side of the first main compressor 21 that is positioned closest to the low-stage side of the multi-stage compressor or to a suction side of the main compressor 121, which is a single-stage compressor.

Although the embodiment of the present disclosure is described above, it is to be understood that various changes can be made in the forms and details without departing from the spirit and the scope of the present disclosure described in the claims.

INDUSTRIAL APPLICABILITY

The present disclosure is widely applicable to a refrigeration cycle device in which an injection pipe and an economizer heat exchanger are provided at a refrigerant circuit having a compressor, a heat-source-side heat exchanger, a usage-side heat exchanger, and a flow-path switching mechanism, the injection pipe causing a refrigerant that flows between the heat-source-side heat exchanger and the usage-side heat exchanger to branch off and to be sent to the compressor, the economizer heat exchanger cooling a refrigerant that flows between the heat-source-side heat exchanger and the usage-side heat exchanger by heat exchange with a refrigerant that flows in the injection pipe.

REFERENCE SIGNS LIST

1 refrigeration cycle device
9 control unit
20 main refrigerant circuit
21, 22, 121 main compressor
21*a* low-stage-side compression element
22*a* high-stage-side compression element
121*a* compression element
121*b* intermediate injection port
23 first main flow-path switching mechanism
25 main heat-source-side heat exchanger
26 intermediate heat exchanger
27 upstream-side main expansion mechanism
31 injection pipe
32 economizer heat exchanger
33 injection expansion mechanism
72*a*, 72*b* main usage-side heat exchanger
80 sub-refrigerant circuit
81 sub-compressor
82 sub-flow-path switching mechanism
83 sub-heat-source-side heat exchanger
85 sub-usage-side heat exchanger

CITATION LIST

Patent Literature

PTL 1: Japanese Unexamined Patent Application Publication No. 2013-139938

The invention claimed is:

1. A refrigeration cycle device comprising:

a main refrigerant circuit having a main compressor that compresses a main refrigerant, a main heat-source-side heat exchanger that selectively functions as a radiator and an evaporator of the main refrigerant, a main usage-side heat exchanger that selectively functions as an evaporator and a radiator of the main refrigerant, an injection pipe that causes the main refrigerant that flows between the main heat-source-side heat exchanger and the main usage-side heat exchanger to branch off and to be sent to the main compressor, an economizer heat exchanger that cools the main refrigerant that flows between the main heat-source-side heat exchanger and the main usage-side heat exchanger by heat exchange with the main refrigerant that flows in the injection pipe, and a main flow-path switching mechanism that switches between a main cooling operation state, in which the main refrigerant is caused to circulate so that the main usage-side heat exchanger functions as the evaporator of the main refrigerant, and a main heating operation state, in which the main refrigerant is caused to circulate so that the main usage-side heat exchanger functions as the radiator of the main refrigerant, wherein the main refrigerant circuit has a sub-usage-side heat exchanger that selectively functions as a cooler and a heater of the main refrigerant that has been cooled at the economizer heat exchanger; and a sub-refrigerant circuit having a sub-compressor that compresses a sub-refrigerant, a sub-heat-source-side heat exchanger that selectively functions as a radiator and an evaporator of the sub-refrigerant, the sub-usage-side heat exchanger that selectively functions as an evaporator of the sub-refrigerant and cools the main refrigerant that has been cooled at the economizer heat exchanger, and selectively functions as a radiator of the sub-refrigerant and heats the main refrigerant that has been cooled at the economizer heat exchanger, and a sub-flow-path switching mechanism that switches between a sub-cooling operation state, in which the sub-refrigerant is caused to circulate so that the sub-usage-side heat exchanger functions as the evaporator of the sub-refrigerant, and a sub-heating operation state, in which the sub-refrigerant is caused to circulate so that the sub-usage-side heat exchanger functions as the radiator of the sub-refrigerant, wherein the main refrigerant flows in the order of the main compressor, the main heat-source-side heat exchanger, the economizer heat exchanger, the sub-usage-side heat exchanger and the main usage-side heat exchanger during the main cooling operation state.

2. The refrigeration cycle device according to claim 1, wherein the main compressor includes a low-stage-side compression element that compresses the main refrigerant and a high-stage-side compression element that compresses the main refrigerant discharged from the low-stage-side compression element, wherein the main refrigerant circuit has an intermediate heat exchanger, and wherein, when the main flow-path switching mechanism is in the main cooling operation state, the intermediate heat exchanger functions as a cooler of the main refrigerant that flows between the low-stage-side compression element and the high-stage-side compression element, and, when the main flow-path switching mechanism is in the main heating operation state, the intermediate heat exchanger functions as an evaporator of the main refrigerant that has been heated at the sub-usage-side heat exchanger.

3. The refrigeration cycle device according to claim 1, wherein the main compressor includes a compression element having an intermediate injection port to which the main refrigerant is introduced from outside in a midway portion of the compression stroke, and wherein the injection pipe is connected to the intermediate injection port.

4. The refrigeration cycle device according to claim 1, wherein the main compressor includes a low-stage-side compression element that compresses the main refrigerant and a high-stage-side compression element that compresses the main refrigerant discharged from the low-stage-side compression element, and wherein the injection pipe is connected on a suction side of the high-stage-side compression element.

5. The refrigeration cycle device according to claim 1, wherein the main refrigerant circuit has a main expansion mechanism between the economizer heat exchanger and the sub-usage-side heat exchanger.

6. The refrigeration cycle device according to claim 5, further comprising:

a controller that controls a constituent device of the main refrigerant circuit and a constituent device of the sub-refrigerant circuit, wherein the controller controls the constituent device of the main refrigerant circuit and the constituent device of the sub-refrigerant circuit so that the main refrigerant circuit and the sub-refrigerant circuit are interlocked.

7. The refrigeration cycle device according to claim 1, wherein the main refrigerant is carbon dioxide, and wherein the sub-refrigerant is a HFC refrigerant, a HFO refrigerant, or a mixture refrigerant in which the HFC refrigerant and the HFO refrigerant are mixed, the HFC refrigerant, the HFO refrigerant, and the mixture refrigerant having a GWP that is 750 or less.

8. The refrigeration cycle device according to claim 1, wherein the main refrigerant is carbon dioxide, and wherein the sub-refrigerant is a natural refrigerant having a coefficient of performance that is higher than a coefficient of performance of the carbon dioxide.

9. The refrigeration cycle device according to claim 2, wherein the main compressor includes a low-stage-side compression element that compresses the main refrigerant and a high-stage-side compression element that compresses the main refrigerant discharged from the low-stage-side compression element, and wherein the injection pipe is connected on a suction side of the high-stage-side compression element.

10. The refrigeration cycle device according to claim 2, wherein the main refrigerant circuit has a main expansion mechanism between the economizer heat exchanger and the sub-usage-side heat exchanger.

11. The refrigeration cycle device according to claim 3, wherein the main refrigerant circuit has a main expansion mechanism between the economizer heat exchanger and the sub-usage-side heat exchanger.

12. The refrigeration cycle device according to claim 4, wherein the main refrigerant circuit has a main expansion mechanism between the economizer heat exchanger and the sub-usage-side heat exchanger.

* * * * *